US007961160B2

(12) United States Patent
Kimura et al.

(10) Patent No.: US 7,961,160 B2
(45) Date of Patent: Jun. 14, 2011

(54) DISPLAY DEVICE, A DRIVING METHOD OF A DISPLAY DEVICE, AND A SEMICONDUCTOR INTEGRATED CIRCUIT INCORPORATED IN A DISPLAY DEVICE

(75) Inventors: Hajime Kimura, Atsugi (JP); Jun Koyama, Sagamihara (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1322 days.

(21) Appl. No.: 10/890,492

(22) Filed: Jul. 14, 2004

(65) Prior Publication Data

US 2005/0024303 A1 Feb. 3, 2005

(30) Foreign Application Priority Data

Jul. 31, 2003 (JP) ..... 2003-283683

(51) Int. Cl.
*G09G 3/32* (2006.01)

(52) U.S. Cl. ..... 345/83

(58) Field of Classification Search ..... 345/205, 345/206, 48, 98, 76–83; 360/69; 313/412, 313/427, 66

See application file for complete search history.

(56) References Cited

U.S. PATENT DOCUMENTS 6,091,203 A 7/2000 Kawashima et al.
6,229,506 B1 5/2001 Dawson et al.
6,329,758 B1 * 12/2001 Salam ..... 315/169.2
6,369,516 B1 * 4/2002 Iketsu et al. ..... 315/169.3
6,373,454 B1 4/2002 Knapp et al.
(Continued)

FOREIGN PATENT DOCUMENTS

EP 1 102 234 5/2001
(Continued)

OTHER PUBLICATIONS

Office Action (Chinese Patent Application No. 200410055951.5) Dated Dec. 19, 2008.

(Continued)

*Primary Examiner* — Quan-Zhen Wang
*Assistant Examiner* — Shaheda A Abdin
(74) *Attorney, Agent, or Firm* — Eric J. Robinson; Robinson Intellectual Property Law Office, P.C.

(57) ABSTRACT

A display device in which a current supplied to a light emitting element is corrected depending on a degradation level of the light emitting element and display variations due to the degradation of each light emitting element are suppressed. Further, according to the display device of the invention, the effect of variations in TFTs is reduced and writing time of a signal is shortened. To achieve the aforementioned display device, according to the invention, a current value supplied to a light emitting element is corrected in accordance with the degradation thereof instead of correcting a video signal. Further, the display device comprises at least a supply source for supplying a corrected current depending on the degradation of a light emitting element and a current source for supplying the corrected current from the supply source to the light emitting element. Moreover, according to such a display device, a first current source of the supply source supplies a corrected current corresponding to the degradation of the least degraded light emitting element of the light emitting elements connected to the same signal line, meanwhile a second current source supplies a corrected current corresponding to the degradation of the most degraded light emitting element of the light emitting elements connected to the same signal line.

22 Claims, 18 Drawing Sheets

U.S. PATENT DOCUMENTS

| | | | | |
|---|---|---|---|---|
| 6,380,687 | B1 * | 4/2002 | Yamazaki | 315/169.3 |
| 6,613,610 | B2 * | 9/2003 | Iwafuchi et al. | 438/128 |
| 6,806,857 | B2 * | 10/2004 | Sempel et al. | 345/92 |
| 7,199,771 | B2 | 4/2007 | Yamazaki et al. | |
| 7,688,291 | B2 | 3/2010 | Yamazaki et al. | |
| 2001/0033252 | A1 | 10/2001 | Yamazaki et al. | |
| 2002/0033783 | A1 * | 3/2002 | Koyama | 345/82 |
| 2003/0063053 | A1 | 4/2003 | Yamazaki et al. | |
| 2003/0071576 | A1 | 4/2003 | Koyama | |
| 2003/0071804 | A1 | 4/2003 | Yamazaki et al. | |
| 2003/0071821 | A1 | 4/2003 | Sundahl et al. | |
| 2003/0090447 | A1 | 5/2003 | Kimura | |
| 2003/0128199 | A1 | 7/2003 | Kimura | |
| 2003/0132931 | A1 | 7/2003 | Kimura et al. | |
| 2003/0156102 | A1 | 8/2003 | Kimura | |
| 2003/0201727 | A1 | 10/2003 | Yamazaki et al. | |
| 2003/0214465 | A1 | 11/2003 | Kimura | |
| 2003/0214466 | A1 | 11/2003 | Kimura | |
| 2003/0218584 | A1 | 11/2003 | Kimura | |
| 2004/0008072 | A1 | 1/2004 | Kimura et al. | |
| 2004/0008166 | A1 | 1/2004 | Kimura | |
| 2004/0041752 | A1 | 3/2004 | Kimura | |
| 2004/0085029 | A1 | 5/2004 | Kimura | |
| 2004/0085270 | A1 | 5/2004 | Kimura | |
| 2004/0115849 | A1 | 6/2004 | Iwafuchi et al. | |
| 2007/0087644 | A1 | 4/2007 | Iwafuchi et al. | |

FOREIGN PATENT DOCUMENTS

| | | |
|---|---|---|
| EP | 1310934 | 5/2003 |
| EP | 1310939 | 5/2003 |
| JP | 11-282419 | 10/1999 |
| JP | 2001-042822 | 2/2001 |
| JP | 2001-42822 | 2/2001 |
| JP | 2001-134234 | 5/2001 |
| JP | 2001-147659 | 5/2001 |
| JP | 2002-514320 | 5/2002 |
| JP | 2002-175041 | 6/2002 |
| JP | 2002-278497 | 9/2002 |
| JP | 2002261335 | 9/2002 |
| JP | 2003-066909 | 3/2003 |
| JP | 2003-66909 | 3/2003 |
| JP | 2003-177713 | 6/2003 |
| JP | 2003-202833 | 7/2003 |
| JP | 2003-202838 | 7/2003 |
| JP | 2003-228333 | 8/2003 |
| JP | 2003-255880 | 9/2003 |
| JP | 2004-046127 | 2/2004 |
| JP | 2004-046128 | 2/2004 |
| JP | 2004-046129 | 2/2004 |
| JP | 2004-046130 | 2/2004 |
| JP | 2004-126512 | 4/2004 |
| WO | WO 98/48403 | 10/1998 |
| WO | WO 03/038793 | 5/2003 |
| WO | WO 03/038795 | 5/2003 |
| WO | WO 03/038797 | 5/2003 |

OTHER PUBLICATIONS

M.T. Johnson et al., "Active Matrix PolyLED Displays," IDW '00, pp. 235-238.

* cited by examiner

DISPLAY DEVICE, A DRIVING METHOD OF A DISPLAY DEVICE, AND A SEMICONDUCTOR INTEGRATED CIRCUIT INCORPORATED IN A DISPLAY DEVICE

BACKGROUND OF THE INVENTION

1. Field of the Invention

The present invention relates to a display device, particularly an active matrix display device having self-light emitting elements, and to a driving method of a display device. The invention further relates to a semiconductor integrated circuit incorporated in a display device.

2. Description of the Related Art

In recent years, a display device using a light emitting element (self-light emitting element) has been studied and developed. Such a display device has the advantages of high image quality, reduced thickness, light weight or the like, and thus it is widely used as a screen of a mobile phone and a monitor of a personal computer. In particular, since the light emitting display device has the features such as low voltage drive, low power consumption, and fast response which contributes to dynamic display, it is expected to be used for various electronic apparatuses typified by a next-generation mobile phone and a portable information terminal (PDA).

A light emitting element is also called an organic light emitting diode (OLED). It comprises an anode, a cathode, and a layer including an organic compound or an inorganic compound (hereinafter referred to as an electro luminescent layer). The electro luminescent layer is interposed between the anode and the cathode and generates luminescence when an electric field is applied thereto. There is a relation between the amount of current flowing in the light emitting element and the luminance thereof, and the light emitting element emits light at a luminance corresponding to the amount of current flowing in its electro luminescent layer.

As a method for inputting a signal to a pixel when displaying a multi-gradation image in a light emitting display device, either an analog gray scale method (analog driving method) or a digital gray scale method (digital driving method) may be adopted. These methods are different in the way of controlling a light emitting element during a light emission or a non-light emission of the light emitting element.

In the analog gray scale method, gray scale is achieved by continuously controlling the amount of current flowing in a light emitting element. Meanwhile, in the digital gray scale method, the display device is driven by switching two states of the light emitting element, namely, an ON state (the luminance is substantially 100%) and an OFF state (the luminance is substantially 0%). In the digital gray scale method, however, not more than two-level gray scale display can be achieved without any complement. Therefore, an area gray scale method or a time gray scale method is suggested to be used as a driving method for displaying a multi-gradation image. In the time grayscale method, one frame period is divided into a plurality of subframe periods so as to have different lengths of light emitting time, and gray scale display is achieved by selecting the subframe periods. On the other hand, in the area gray scale method, a pixel is divided into subpixels so as to have different light emitting areas and gray scale display is achieved by selecting the subpixels.

A driving method when displaying a multi-gradation image in a light emitting display device is broadly classified into a voltage input method and a current input method. These two methods can adopt both the analog gray scale method and the digital gray scale method.

In the voltage input method, a video signal having a voltage value is input to a pixel and then to a gate electrode of a driving element in the pixel, whereby controlling the luminance of a light emitting element by the use of the driving element. When adopting the analog gray scale method in this case, the effect of variations in thin film transistors (TFTs) is increased.

In the current input method, a predetermined signal current is supplied to a driving element in a pixel and then to a light emitting element, whereby controlling the luminance of the light emitting element. In this case, multi-level gray scale is achieved in accordance with a current value supplied to the light emitting element. Accordingly, the amount of writing time is increased because of a signal input with current.

The luminance of a light emitting element in the aforementioned display device degrades with time (hereinafter referred to as the degradation with time) as shown below. FIG. 15A is a graph showing a voltage applied to a light emitting element relative to a current supplied to the light emitting element. The graph of FIG. 15A shows that when applying a voltage V0, a predetermined luminance is obtained at a current Ia firstly, but the luminance is lowered because the current drops to Ib even when applying the voltage V0 due to the degradation with time.

As shown in a graph of FIG. 15B which shows current-luminance characteristics of a light emitting element, the luminance of the light emitting element at a current I0 drops from La to Lb as time passes.

A light emitting element generates heat when voltage or current is applied thereto. Accordingly, film quality of an electro luminescent layer degrades or interfaces between the electro luminescent layers and electrodes degrade, and this is considered to be a cause of the luminance decay. Further, each light emitting element degrades differently, leading to image persistence.

Thus, in the case of adopting the voltage input method, suggested is a display device in which a uniform screen without variations in luminance can be achieved by correcting an image signal (video signal) depending on the correction data which is stored in advance in accordance with a degradation level of a self-light emitting element (see Patent Document 1). More specifically, it is a display device using the time gray scale method in order to display a multi-gradation image, and in the display device, one bit of subframe is used for correcting a video signal. For example, in the case of a light emitting display device using 6-bit digital gray scale, one bit of processing power is added for video signal correction, and the display device is designed and fabricated as the one for 7-bit digital gray scale. In a normal operation, the lower six bits are employed. Meanwhile, in the case where a light emitting element degrades, a correction value is added to a normal digital image signal and processed by using an additional one bit.

As shown in FIG. 18, the voltage input method may be combined with the current input method. In that case, each pixel of a light emitting display device is provided with a plurality of transistors PchTFTs 1 to 3 each gate electrode of which is connected with each other and which have different current capacities. The current supply capacity of each of the transistors is set to be proportional to an arbitrary current value. Then, whether to supply current to light emitting elements or not is controlled by turning ON/OFF switches SW1A to SW3A provided between drain electrodes of transistors and the light emitting elements in accordance with digital gray scale data $D_0$ to $D_2$. According to this, a high accuracy current which is affected only by variations in characteristics of transistors in the adjacent areas can be supplied to the light emitting elements (see Patent Document 2).

[Patent Document 1]

Japanese Patent Laid-Open No. 2002-175041

[Patent Document 2]

Japanese Patent Laid-Open No. 2003-66909

SUMMARY OF THE INVENTION

As set forth above, each light emitting element degrades differently in a display device. As a result, the degradation level varies in each pixel even when all the pixels are required to emit light at the same luminance. In the case where a degraded pixel is disposed adjacent to a pixel which does not degrade at all or a pixel which degrades little, the luminance of the degraded pixel is lower than the other pixels, leading to image persistence. The image persistence causes low quality display in the display device.

In a display device adopting the voltage input method disclosed in Patent Document 1, a video signal is corrected. Thus, when the magnitude of a video signal after being corrected, namely the amount of light emitting time, is maximized, the amount of light emitting time can not be increased any more, that is, the magnitude of the video signal can not be increased any more. Further, the actual gray scale level of a panel is lower than the inherent gray scale level. That is, as described above, in a panel which can display an image with 7-bit gray scale, one bit is used for correcting the video signal, and actually, an image is displayed with 6-bit gray scale only.

Moreover, in the case of the voltage input method adopting the analog gray scale method, a display device is easily affected by variations in TFTs as described above. On the other hand, in the case of the current input method, the writing time of a signal current is lengthened.

Even when using the correcting method disclosed in Patent Document 1 in combination with the pixel configuration disclosed in Patent Document 2, digital gray scale data $D_0$ to $D_2$ are corrected and thus the problem described in the preceding paragraph cannot be solved. That is, since one of the digital gray scale data $D_0$ to $D_2$ is used for correcting a video signal, for example, in a panel which can display an image with 3-bit gray scale, an image can be displayed only with 2-bit gray scale actually because one bit is used for correcting the video signal. Accordingly, the actual gray scale level of a panel is lower than the inherent gray scale level.

In view of the foregoing, the invention provides a display device in which display variations due to different degradation levels of each light emitting element are suppressed by correcting a current supplied to each light emitting element in accordance with the degradation level thereof. The invention further provides a display device which is not affected by variations in TFTs and in which the writing time of a signal is shortened.

In view of the aforementioned problems, according to the invention, a current value supplied to a light emitting element is corrected depending on the degradation of the light emitting element instead of correcting a video signal.

To solve the aforementioned problems, according to an aspect of the invention, a display device comprises at least a supply source for supplying a corrected current depending on the degradation of a light emitting element, and a current source for supplying the corrected current from the supply source to the light emitting element.

According to another aspect of the invention, a display device comprises at least a light emitting element provided at an intersection of a signal line and a scan line, a supply source for supplying a corrected current depending on the degradation of the light emitting element, and a current source for supplying the corrected current from the supply source to the light emitting element, and further comprises a first switch connected to the signal line and the scan line, and a second switch provided between the current source and the light emitting element.

According to another aspect of the invention, a display device comprises at least a supply source for supplying a corrected current depending on the degradation of a light emitting element, a control means for controlling the supply source, and a current source for supplying the corrected current from the supply source to the light emitting element.

According to another aspect of the invention, a display device comprises at least a light emitting element provided at an intersection of a signal line and a scan line, a supply source for supplying a corrected current depending on the degradation of the light emitting element, a control means for controlling the supply source, and a current source for supplying the corrected current from the supply source to the light emitting element, and further comprises a first switch connected to the signal line and the scan line, and a second switch provided between the current source and the light emitting element.

According to another aspect of the invention, a display device comprises as least a counter means which includes a means for measuring the amount of light emitting time of a light emitting element, and a means for setting a correction signal in accordance with the amount of light emitting time and the degradation of the light emitting element, a supply source for supplying a corrected current depending on the correction signal, a control means for controlling the correction signal which is input to the supply source, and a current source for supplying the corrected current from the supply source to the light emitting element.

According to another aspect of the invention, a display device comprises at least a light emitting element provided at an intersection of a signal line and a scan line, a counter means which includes a means for measuring the amount of light emitting time of the light emitting element, and a means for setting a correction signal in accordance with the amount of light emitting time and the degradation of the light emitting element, a supply source for supplying a corrected current depending on the correction signal, a control means for controlling the correction signal which is input to the supply source, and a current source for supplying the corrected current from the supply source to the light emitting element, and further comprises a first switch connected to the signal line and the scan line, and a second switch provided between the current source and the light emitting element.

According to another aspect of the invention, a display device comprises at least a storage means for storing degradation data of a light emitting element, a counter means which includes a means for measuring the amount of light emitting time of the light emitting element, and a means for setting a correction signal in accordance with the amount of light emitting time and the degradation data, a supply source for supplying a corrected current depending on the correction signal, a control means for controlling the correction signal which is input to the supply source, and a current source for supplying the corrected current from the supply source to the light emitting element.

According to another aspect of the invention, a display device comprises as least a light emitting element provided at an intersection of a signal line and a scan line, a storage means for storing degradation data of the light emitting element, a counter means which includes a means for measuring the amount of light emitting time of the light emitting element, and a means for setting a correction signal in accordance with the amount of light emitting time and the degradation data, a supply source for supplying a corrected current depending on the correction signal, a control means for controlling the correction signal which is input to the supply source, a current source for supplying the corrected current from the supply source to the light emitting element, a first switch connected to the signal line and the scan line, and a second switch provided between the current source and the light emitting element.

According to the invention, a supply source comprises a current source, and the current source is provide for each of the signal lines.

According to the invention, a supply source comprises a pair of first current source and second current source, and the pair of current sources are provided for each of the signal lines.

According to the invention, a current source for supplying a corrected current comprises a transistor and a capacitor for holding a gate-source voltage of the transistor.

According to the invention, a current source and the supply source are connected to each other via a current line.

According to the invention, a control means comprises either a shift register or a decoder.

According to the invention, a control means comprises either the shift register or the decoder, a first latch circuit, and a second latch circuit.

According to the invention, a current source can be shared between a control means and the supply source.

According to the invention, a shift register and a latch circuit can be shared between a control means and a signal line driver circuit for driving the signal line.

According to another aspect of the invention, a display device comprises a semiconductor integrated circuit which stores degradation data of a light emitting element and calculates a correction signal corresponding thereto.

According to an aspect of the invention, a semiconductor integrated circuit comprises a storage means for storing degradation data of a light emitting element, and a counter means which includes a means for measuring the amount of light emitting time of the light emitting element, and a means for setting a correction signal in accordance with the amount of light emitting time and the degradation data.

According to the semiconductor integrated circuit of the invention, a means for measuring the amount of light emitting time of a light emitting element, which is included in a counter means, comprises a counter circuit.

According to the semiconductor integrated circuit of the invention, a storage means comprises a non-volatile memory, and the non-volatile memory records degradation data of the light emitting element.

According to the semiconductor integrated circuit of the invention, a storage means comprises a non-volatile memory and a volatile memory, and the volatile memory records display data.

According to the semiconductor integrated circuit of the invention, a storage means and a counter means comprise a semiconductor element which is provided on a silicon wafer.

According to the aforementioned configuration, a display device of the invention can be driven so that the first current source supplies a corrected current corresponding to the degradation of the least degraded light emitting element of the light emitting elements connected to the same signal line, meanwhile the second current source supplies a corrected current corresponding to the degradation of the most degraded light emitting of the light emitting elements connected to the same signal line.

According to the aforementioned configuration, a display device of the invention can be driven so that a current value between a first current value corresponding to the least degraded light emitting element of the light emitting elements connected to the same signal line and a second current value corresponding to the most degraded light emitting element is divided into a plurality of current values, and the plurality of current sources supply a plurality of current values including the first and the second current values.

According to the aforementioned driving method, the number of a plurality of current values determined by dividing a current value is equal to that of the current sources. Further, the degradation of the light emitting element can be corrected by using a video signal input to the signal line.

According to an aspect of the invention, a digital driving method is adopted, in which a switch portion is driven by using a digital video signal to select whether a predetermined signal current is supplied to a light emitting element or not, thereby switching a light emitting state and a non-light emitting state. Further, time gray scale is adopted in order to achieve a multi-level gray scale display.

Note that according to the invention, it is possible to provide a single or a plurality of current sources for supplying a corrected current from a supply source to a light emitting element, namely current sources connected to the light emitting element.

A transistor used for the invention is not exclusively limited. It may be a thin film transistor (also referred to as a TFT hereinafter) using a non-single crystalline semiconductor film represented by amorphous silicon or polycrystalline silicon, a MOS transistor formed by using a semiconductor substrate or an SOI substrate, a junction transistor, a transistor using an organic semiconductor or a carbon nanotube, or the like. Further, a substrate on which a transistor is mounted is not exclusively limited, and it may be a single crystalline substrate, an SOI substrate, a glass substrate, or the like.

A display device comprising a light emitting element is described above. However, the application range of the invention is so wide that it can be applied to the case in which a current value corrected depending on changes (degradation and the like) in a load can be supplied to the load.

According to the invention, a signal current supplied to a light emitting element can be corrected as the light emitting element varies with time, whereby reducing display variations due to image persistence. Also according to the invention, luminance decay of a light emitting element due to the degradation thereof can be prevented by setting a signal current corresponding to the degradation of the light emitting element, leading to the prevention of lowered image quality.

Moreover, according to a pixel configuration of the invention, a display device which is less affected by variations in semiconductor elements included in driving current sources.

Further, according to the invention, a signal current corrected in accordance with the degradation of each light emitting element can be set. Therefore, each light emitting element can be driven more accurately as compared with in the case of correcting a signal current depending on the most degraded light emitting element, and power consumption can be suppressed.

DETAILED DESCRIPTION OF THE INVENTION

Embodiment modes of the invention will be hereinafter described with reference to drawings. Note that, in all the drawings used for the explanation of embodiment modes, like components are denoted by like numerals and will be explained in no more details.

Embodiment Mode 1

In this embodiment mode, a function and a configuration of a display device of the invention is described.

Figure 1A:
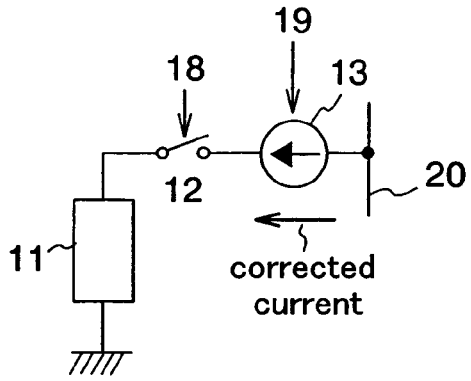
FIGS. 1A to 1C are block diagrams each showing a display device of the invention.

As shown in FIG. 1A, a display device of the invention, particularly a pixel thereof comprises a light emitting element 11 and a current source 13 (hereinafter referred to as a driving current source) connected to the light emitting element 11 via a switch 12. The switch 12 has a function of switching a light emission and a non-light emission by selecting according to a video signal 18 whether a current from the current source 13 is supplied to the light emitting element 11 or not. The driving current source 13 is connected to a power supply line 20 and controlled by a signal 19 (hereinafter referred to as a control signal) which is different from the video signal 18. It is to be noted that components other than the switch 12 may be provided between the light emitting element 11 and the driving current source 13. In other words, it is only necessary that the light emitting element 1 be electrically connected to the driving current source 13.

According to such a configuration of the invention, a current value (hereinafter referred to as a signal current) supplied to the light emitting element 11 is set and the current value can be corrected in accordance with the degradation of the light emitting element 11.

Figure 1B:
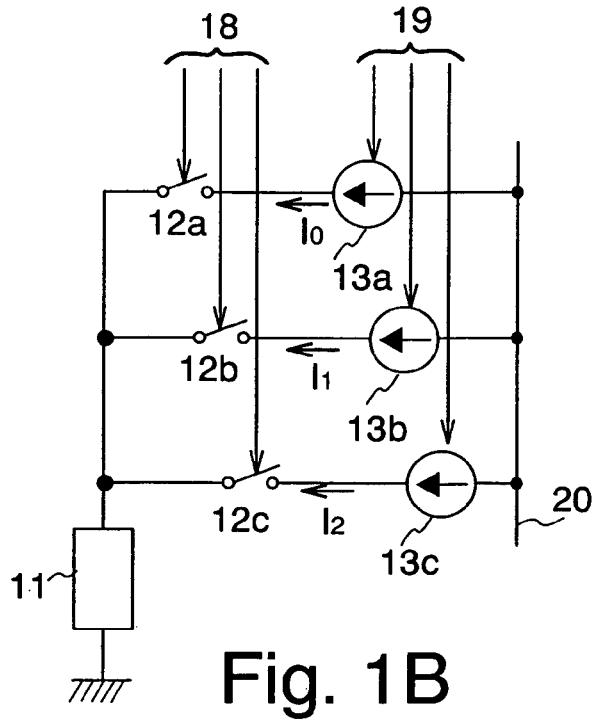

As shown in FIG. 1B, a display device of the invention, particularly a pixel thereof may comprise a plurality of driving current sources 13*a* to 13*c*. In this case, a plurality of control signals 19 are provided for controlling the plurality of driving current sources 13*a* to 13*c*, a plurality of switches 12*a* to 12*c* are provided in accordance with the plurality of driving current sources 13*a* to 13*c* respectively, and a plurality of video signals 18 are supplied to the plurality of switches 12*a* to 12*c*.

In the case of using a plurality of driving current sources 13*a* to 13*c* as described above, gray scale display having the corresponding number of bits can be achieved. For example, a current $I_1=2\times I_0$ can be supplied from one of the driving current sources and a current $I_1=4\times I_0$ can be supplied from another of the driving current sources.

Figure 1C:
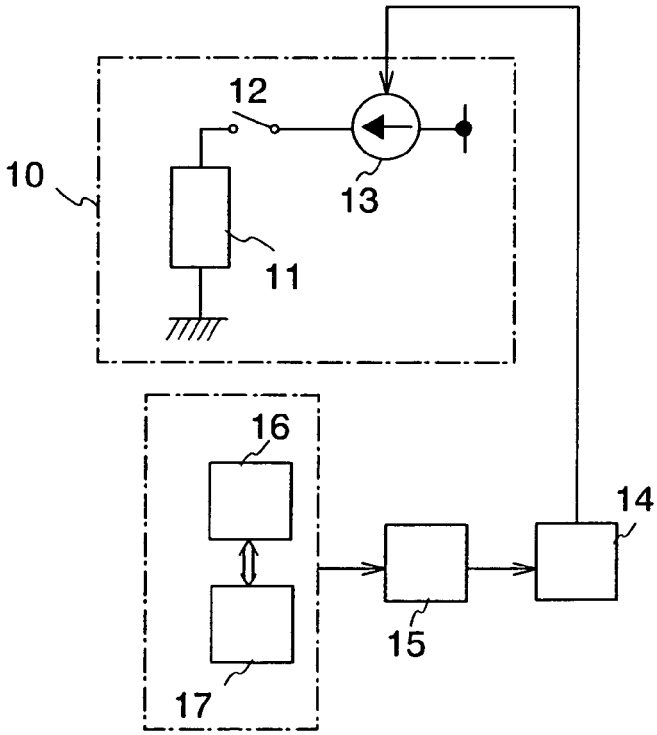

As shown in FIG. 1C, a display device which includes the pixel of the invention shown in FIGS. 1A and 1B comprises a pixel 10 including the light emitting element 11, the switch 12 and the driving current source 13, a signal supply source 14 for setting a signal current depending on the degradation of the light emitting element 11 to be supplied to the driving current source 13, a control means 15 for controlling the signal supply source 14, a storage means 16 for storing degradation data of the light emitting element 11, and a counter means 17 for measuring a degradation level of the light emitting element 11.

It is to be noted that according to the invention, the storage means and the current source of the signal supply source may be provided in each pixel.

In FIG. 1C, the storage means 16 and the counter means 17 generate a signal (hereinafter referred to as a correction signal) which includes data on the degradation level of a light emitting element and the correction of a signal current value and the like required to be corrected in accordance with the degradation level. The correction signal is input to the control means 15 which sets a current to be supplied to the signal supply source 14. Then, depending on the current value of the signal supply source 14, a current to be supplied to the driving current source 13 is set. As a result, a corrected signal current is supplied from the driving current source 13 to the light emitting element 11.

In the invention, setting of a signal current means that a driving current source 13 is set so as to be capable of supplying a predetermined signal current, in particular, setting of a corrected signal current means that the driving current source is set so as to supply a corrected signal current.

The signal supply source 14 should have a function of setting a signal current corrected in accordance with a correction signal, and may comprise a current source for example. The current source is preferably connected to each signal line. Further, a plurality of current sources may be connected to each signal line. In that case, one of the current sources is referred to as a reference current source and the other is referred to as a correction current source to distinguish them based on the way of correcting.

The control means 15 should have a function of setting a signal supply source in accordance with a correction signal generated in the storage means 16 and the counter means 17, and may comprise a shift register or a latch circuit for example.

Moreover, one current source 14 may be used as both of a signal current source and a latch circuit. According to this, an area occupied by a driver circuit portion can be reduced, leading to a narrower frame.

In a signal line driver circuit, a latch circuit and a shift register may be provided in the case of using a line sequential driving method where video signals are simultaneously input to a line of light emitting elements. Meanwhile, a shift register may be provided in the case using of a point sequential driving method where a video signal is input to each light emitting element.

The storage means 16 may have a means for storing data, for example a non-volatile memory or a magnetic memory, in order to record degradation data of a light emitting element in the non-volatile memory and the like. The degradation data includes reference data which records changes in the current value required for obtaining a constant luminance and stored data which holds the degradation of a light emitting element with time. The storage means may further comprise a volatile memory and the like for recording display data.

Figure 11:
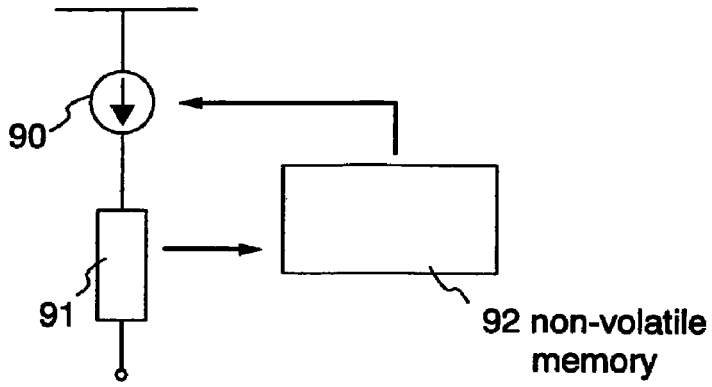
FIG. 11 is a diagram showing reference data measurement of the invention.

The reference data is obtained by driving a test light emitting element in advance and measuring the degradation thereof with time. For example, as shown in FIG. 11, aging is performed by using a test element comprising a current source 90 and a light emitting element 91. Then, a current required for obtaining a constant luminance in the light emitting element 91, namely a current corresponding to the degradation with time is recorded in a non-volatile memory 92.

The stored data can be obtained sequentially by measuring the degradation of each light emitting element with time in an actual display device. For example, a counter circuit of the counter means measures the amount of light emitting time of a light emitting element (the amount of time in which a light emitting element emits light actually) in accordance with a video signal. Then, with reference to the reference data, a degradation level of the light emitting element is estimated depending on the amount of light emitting time thereof to store the degradation data.

Such reference data and stored data show the degradation level of the light emitting element, and the counter means determines a signal which indicates how much correction of a signal current is needed, that is, a correction signal. For example, a correction signal corresponding to the amount of light emitting time of a light emitting element is determined by the counter means in accordance with the storage means, and input to the control means. At the same time, a corrected signal current is held in the stored data.

It is to be noted that the current source and circuits of the aforementioned display device of the invention may be formed of transistors, more specifically, thin film transistors having an N-type or a P-type conductivity. In addition, when using thin film transistors having a polycrystalline semiconductor film, the pixel, the signal supply source and the control means can be integrally formed on the same substrate. Needless to say, these components may be formed separately from each other, such that the pixel and the signal supply source, and the control means are formed on different substrates, or the pixel, and the signal supply source and the control means are formed on different substrates.

The counter means and the storage means may be formed separately from the pixel portion, by using semiconductor elements (transistors) formed on a silicon wafer for example. Such counter means and storage means formed separately may be connected to the pixel, the signal supply source and the control means through an ACF (Anisotropic Conductive Film) or an FPC (Flexible Printed Circuit).

According to the invention, a signal current supplied to a light emitting element can be corrected as the light emitting element varies with time, leading to reduced display variations caused by image persistence. Further, since a signal current which is set considering a current to emit a constant light by each light emitting element supplied to the light emitting element is set in the pixel configuration of the invention, it is possible to provide a display device in which variations in a driving current source, more specifically, variations in transistors forming the current source are reduced.

Embodiment Mode 2

In this embodiment mode, a specific pixel configuration of the invention is described with reference to FIGS. 2A and 2B.

Figure 2A:
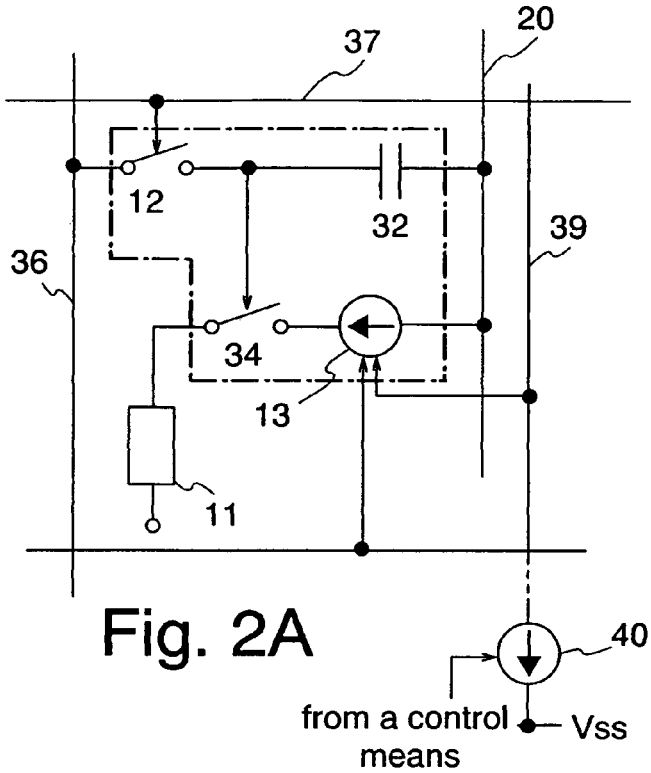
FIGS. 2A and 2B are equivalent circuit diagrams each showing a pixel of the invention.

As shown in FIG. 2A, a pixel comprises at least the light emitting element 11 and an area surrounded by a dotted line which includes a switch 12, the driving current source 13, a capacitor 32, and a switch 34 provided between the driving current source 13 and the light emitting element 11. The switch 12 is connected to a signal line 36 and a scan line 37, and the driving current source 13 and the capacitor 32 are connected to a power supply line 20. A signal from a signal supply current source 40 is input to the driving current source 13 via a current line 39. As described above, the signal supply current source 40 is controlled by a control means and a signal for controlling the switch of the driving current source 13 is input to the signal supply current source 40.

Figure 2B:
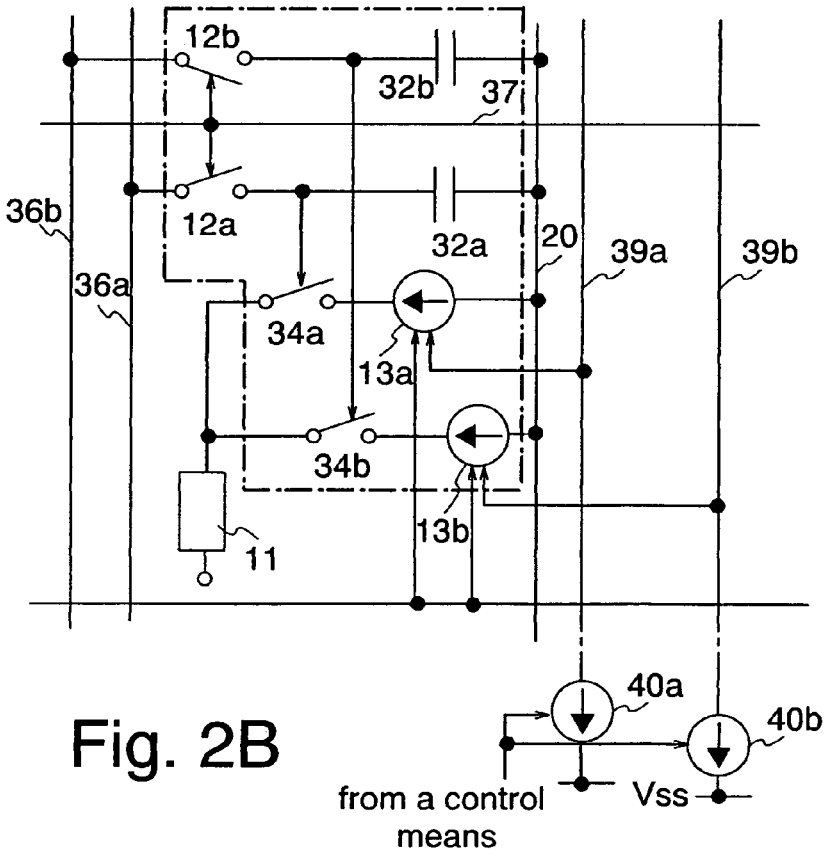

Moreover, a plurality of driving current sources 13*a* and 13*b* may be provided as shown in FIG. 2B. In this case, a plurality of control signals for controlling the plurality of driving current sources 13*a* and 13*b*, namely a plurality of signal supply current sources 40*a* and 40*b* are provided and a plurality of current lines 39*a* and 39*b* are connected thereto respectively. A plurality of switches 34*a* and 34*b* are provided between the light emitting element 11 and the plurality of driving current sources 13*a* and 13*b* respectively in order to control whether a current is supplied to the light emitting element 11 or not. In accordance with the plurality of driving current sources 13*a* and 13*b*, provided are a plurality of switches 12*a* and 12*b*, and signal lines 36*a* and 36*b* to which a plurality of video signals are input to be supplied to the plurality of switches 12*a* and 12*b*. Further, a plurality of capacitors 32*a* and 32*b* are provided between the power supply line 20 and the plurality of switches 12*a* and 12*b* respectively.

In the case of using a plurality of driving current sources 13*a* and 13*b* as described above, gray scale display having the corresponding number of bits can be achieved.

A specific configuration of the driving current source 13 is hereinafter shown and a pixel configuration of the invention is described.

Figure 3A:
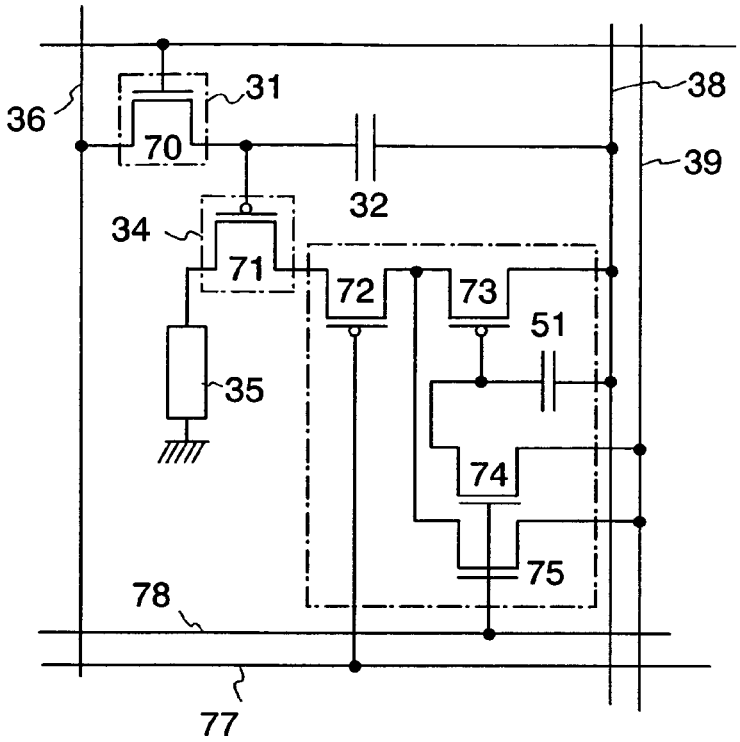
FIGS. 3A and 3B are equivalent circuit diagrams each showing a pixel of the invention.

In FIG. 3A, a transistor 70 which functions as a switch 31 is connected to the signal line 36 and the scan line 37. A transistor 71 which functions as a switch 34 is also provided and the capacitor 32 is provided between a gate electrode of the transistor 71 and a power supply line 38. A light emitting element 35 is connected to one of a source electrode and a drain electrode of the transistor 71. A driving current source surrounded by a dot-line comprises a P-channel transistor 72 which functions as a switch, and one of a source electrode and a drain electrode of the P-channel transistor 72 is connected to a P-channel transistor 73 and an N-channel transistor 75. A gate electrode of the P-channel transistor 72 is connected to a first control line 77. The driving current source further comprises a capacitor 51 for holding a gate-source voltage of the P-channel transistor 73. One of a source electrode and a drain electrode of an N-channel transistor 74 is connected to a gate electrode of the P-channel transistor 73 and the other electrode is connected to a current line 39. Gate electrodes of the N-channel transistors 74 and 75 are connected to a second control line 78.

An operation method of such a pixel configuration is described next.

A signal supply current source is set so as to flow a corrected signal current. The N-channel transistors 74 and 75 are selected by the second control line 78 and turned ON. Then, a current is supplied from the power supply line 38 to one pathway through the P-channel transistor 73 and an N-channel transistor 75 and another pathway through the capacitor 51 and the N-channel transistor 74. The total current of the two pathways is equal to the current through the signal supply current source. Charges are continued to be stored in the capacitor 51 until they become equal to a gate-source voltage of the P-channel transistor 73 functioning as a driving current source, where the P-channel transistor 73 can flow the corrected signal current with the gate-source voltage. As a result, the P-channel transistor 73 obtains a function of flowing the corrected signal current from the signal supply current source.

Note that, a current flowing in the P-channel transistor 73 and that flowing in the signal supply current source do not have to be equal. That is, a current value set to be supplied to the transistor 73 can be varied by changing channel widths of the P-channel transistor 73 and the transistor in the signal supply current source.

Subsequently, input is a signal which turns OFF the N-channel transistors 74 and 75 and turns ON the P-channel transistor 72. At this time, a video signal is input from the signal line 36 to the capacitor 32 via the transistor 70. In the case of inputting a signal which turns ON the transistor 71, a corrected signal current is supplied from the P-channel transistor 73 to the light emitting element 35.

Figure 3B:
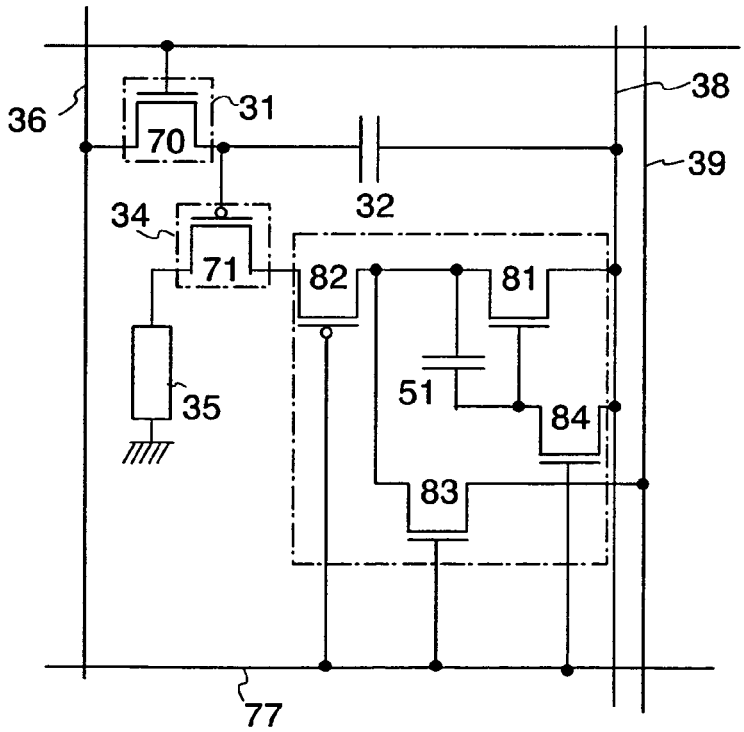

In FIG. 3B, an N-channel transistor is used as a transistor functioning as the driving current source (P-channel transistor 73 in FIG. 3A). One of a source electrode and a drain electrode of an N-channel transistor 81 functioning as a driving current source is connected to the power supply line 38, and the other electrode is connected to a capacitor 51 for holding a gate-source voltage of the N-channel transistor 81. The other electrode of the N-channel transistor 81 is connected to each one of a source electrode or a drain electrode of a P-channel transistor 82 and an N-channel transistor 83. Further, the pixel in FIG. 3B comprises an N-channel transistor 84 one of a source electrode and a drain electrode is connected to a gate electrode of the N-channel transistor 81, and the other electrode of which is connected to the power supply line 38. Gate electrodes of the P-channel transistors 82 and P-channel transistors 83 and 84 are connected to the first control line 77. In this pixel, the second control line is not necessary. In the case of using an P-channel transistor as the driving current source mentioned above, the configuration without the second control line can be achieved by changing the conductivities of other transistors and so on. The other elements are the same as those of the pixel shown in FIG. 3A, therefore, the descriptions thereof are omitted here.

An operation of the pixel configuration shown in FIG. 3B is described next.

First, a signal for turning ON the N-channel transistors 83 and 84 is input from the first control line 77, and the P-channel transistor 82 which has the opposite conductivity is turned OFF at this time. Then, a current is supplied from the power supply line 38 to one pathway through the N-channel transistor 81, the capacitor 51 and the N-channel transistor 84 and another pathway through the N-channel transistors 81 and 83 to the signal supply current source which is connected to the current line 39. At this time, the signal supply current source is set so as to flow a corrected signal current, thus the capacitor 51 holds charges so that the N-channel transistor 81 can flow the corrected current. Accordingly, the N-channel transistor 81 obtains a capability of supplying a corrected signal current.

Subsequently, a signal for turning ON the P-channel transistor 82 is input from the first control line 77, and the N-channel transistors 83 and 84 which have the opposite conductivity type are turned OFF. Then, a video signal is input from the signal line 36 to the capacitor 32 via the transistor 70. In the case where a signal for turning ON the transistor 71 is input, a corrected signal current is input from the N-channel transistor 81 to the light emitting element 35.

The case in which the transistor functioning as the driving current source is formed of a P-channel transistor or an N-channel transistor is described above. Both the conductivity type can be used according to the invention. When the conductivity of transistors is changed, the pixel configuration has to be arbitrarily designed in view of the arrangement of the capacitor and the transistor serving as a switch. That is, the capacitor is needed to be disposed so as to hold a gate-source voltage of a transistor which functions as a driving current source. It is desirable that a potential of a source electrode of the transistor is fixed at this time since the capacitor holds the gate-source voltage. In addition, the switches should be arranged so as to control ON/OFF, and a plurality of switches may be provided as well.

The aforementioned pixel, in particular the driving current source, may adopt the other configurations such as those disclosed in Japanese Patent Application Laid-Open No. 2004-046127, Japanese Patent Application Laid-Open No. 2004-126512, Japanese Patent Application Laid-Open No. 2004-046128, Japanese Patent Application Laid-Open No. 2004-046129, Japanese Patent Application Laid-Open No. 2004-046130, and the like.

Figure 16:
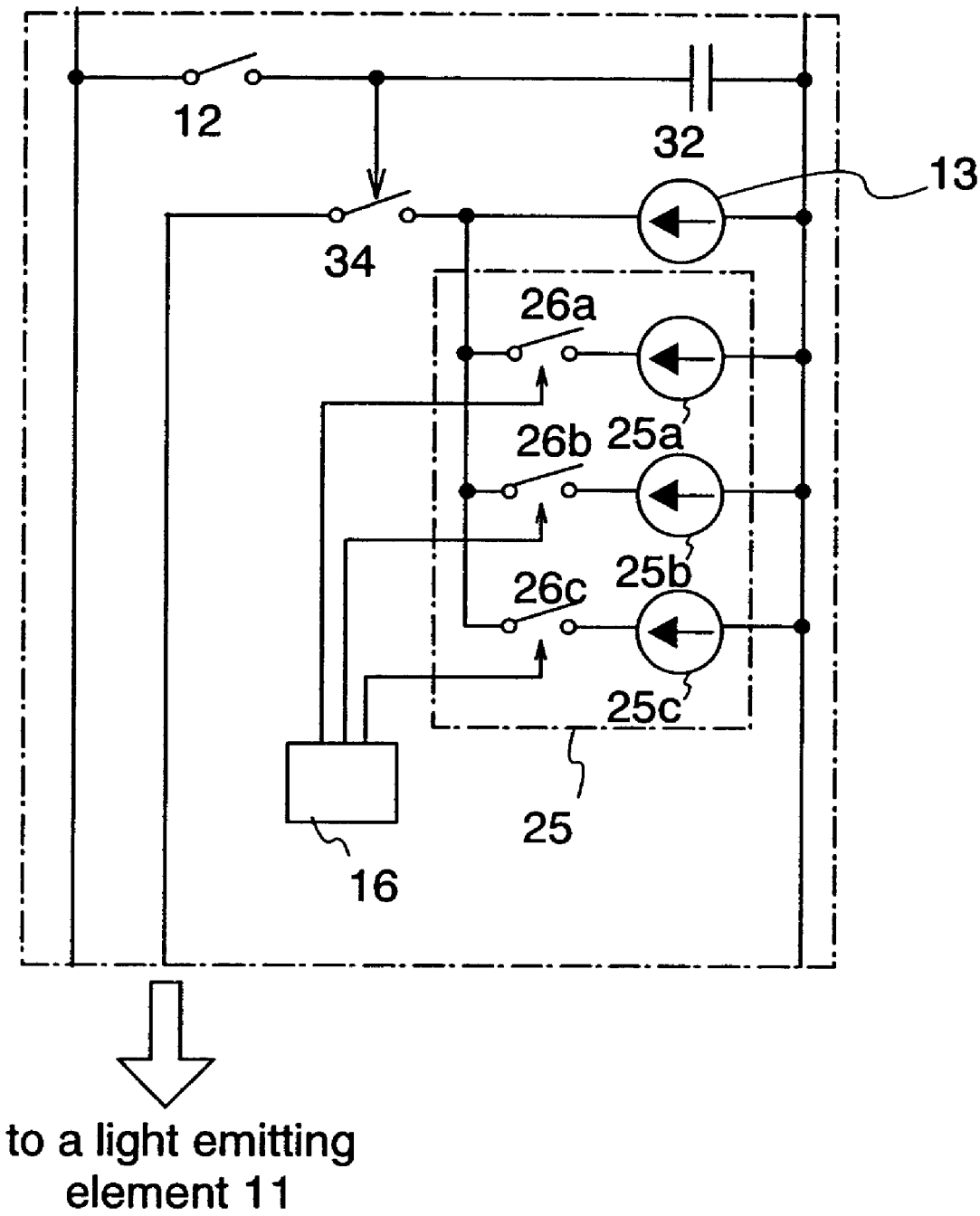
FIG. 16 is an equivalent circuit diagram showing a pixel of the invention.

As shown in FIG. 16, the pixel may further comprise the storage means 16 and a correction current source 25. It is to be noted that FIG. 16 corresponds to a magnified view of an area surrounded by a dotted line in FIG. 2A, which includes the switches 12 and 34, the capacitor 32, and the driving current source 13. Specifically, the correction current source 25 comprises a plurality of current sources 25*a* to 25*c*, and a plurality of switches 26*a* to 26*c* connected to the current sources 25*a* to 25*c* respectively. The correction current source 25 is connected to the driving current source 13, and the driving current source 13 and the correction current source 25 are connected to the light emitting element 11 via the switch 34.

In such a pixel, a corrected signal current is generated in the correction current source 25 in accordance with a degradation level of the light emitting element 11 stored in the storage means 16. According to the corrected signal current, a corrected signal current is set to be supplied to the driving current source 13. When the switch 34 is turned ON, the corrected signal current is supplied to the light emitting element 11.

According to the aforementioned pixel configuration of the invention, a signal current which is corrected in accordance with the degradation of a light emitting element can be supplied to the light emitting element. As a result, it is possible to provide a display device in which image persistence due to the degradation of a light emitting element is suppressed.

Embodiment Mode 3

Many methods are possible to correct a signal current in accordance with the degradation of a light emitting element. That is, the invention is characterized in that a current value is corrected depending on the degradation of a light emitting element, and the method of correcting the current value and the like is not exclusively limited.

In this embodiment mode, shown is a method of correcting a signal current supplied to a light emitting element by using two current sources. Note that in this invention, a single or a plurality of current sources may be employed for correcting a signal current.

Figure 12A:
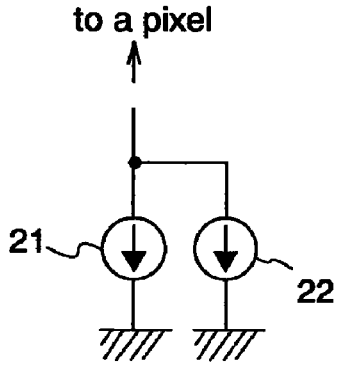
FIGS. 12A and 12B are block diagrams each showing current sources of the invention.

In FIG. 12A, a first current source 21 and a second current source 22 for setting a corrected signal current are shown. The first current source 21 and the second current source 22 are used as a reference current source and a correction current source respectively. The first and the second current sources 21 and 22 are connected to the same current line, and also connected to a pixel, that is, a driving current source.

Figure 12B:
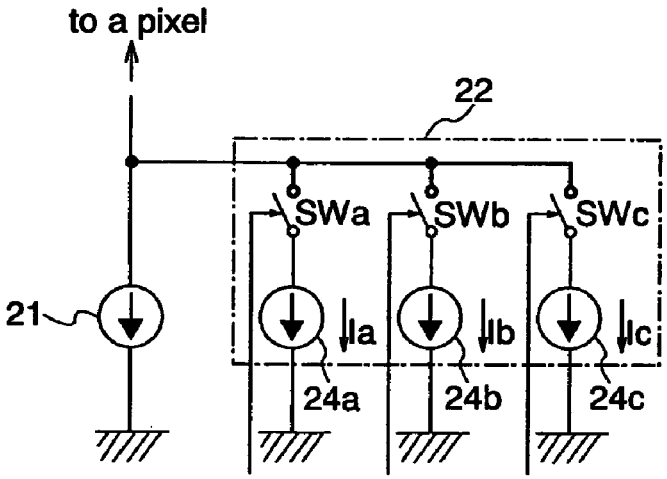

Alternatively, the second current source 22 may comprise a plurality of current sources 24*a* to 24*c* as shown in FIG. 12B. In this case, the plurality of current sources 24*a* to 24*c* are controlled by a plurality of switches SWa to SWc respectively.

In such a case as described above, since the second current source 22 comprises a plurality of current sources, a current corresponding to each of the current sources 24*a* to 24*c* can be supplied.

The aforementioned correcting method using the reference current source and the correction current source is explained in more detail with reference to degradation lines shown in FIGS. 13A to 13C and FIGS. 14A to 14C, which show the degradation of a light emitting element.

Although the degradation lines are shown by straight lines for simplicity, the actual degradation line may be a curved line. That is, as set forth above, the degradation line may be obtained by performing aging with the use of a test light emitting element.

Figure 13A:
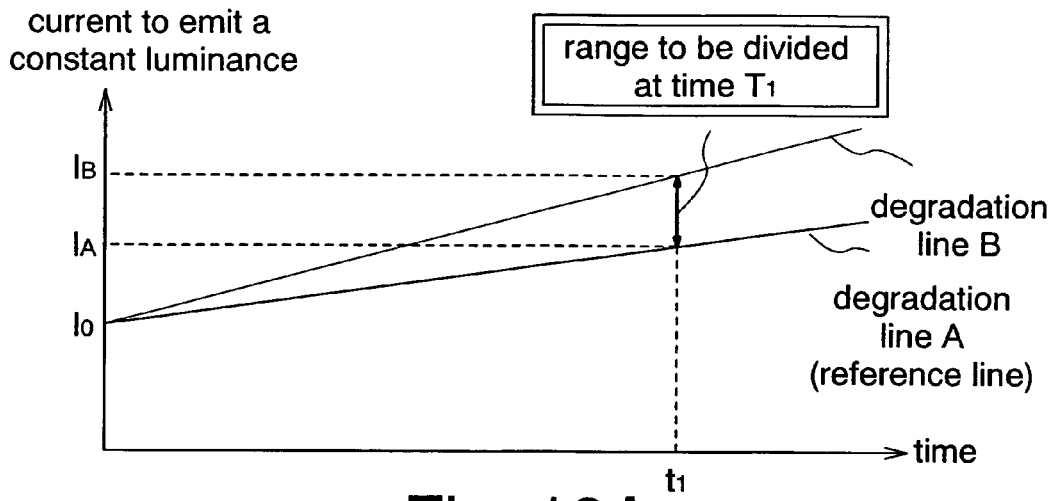
FIGS. 13A to 13C are diagrams each showing a degradation correction method of a light emitting element of the invention.

A graph in FIG. 13A shows a signal current which is supplied to a light emitting element relative to time in the case where the light emitting element emits light at a constant luminance. An initial current $I_0$ represents a signal current required to obtain a predetermined luminance of a light emitting element when t=0 is satisfied. In other words, the initial current $I_0$ represents a signal current value before the degradation with time of a light emitting element. A light emitting element degrades with time, therefore, a signal current required to obtain a predetermined luminance is increased as time passes as shown by degradation lines A and B.

The actual panel comprises a number of light emitting elements each of which degrades differently due to the amount of light emitting time thereof and the like. Accordingly, each light emitting element has to be set by using a signal current corresponding to a degradation level of each of the light emitting elements. That is, a signal current is needed to be output to each of the light emitting elements in accordance with a degradation level thereof.

Thus, in order to correspond to each degradation level of the light emitting elements, a signal current within a certain range is divided into a plurality of signal currents having different amounts. The more the number of divisions, the better is the display performance, namely the correction accuracy. In this embodiment mode, the case of six bits, namely 64 divisions, which is within the range recognizable by the human eye, is taken as an example, though the invention is not limited to this.

In this case, the second current source is needed to be capable of supplying 64 different signal currents. Therefore, the second current source comprises six current sources each of which may supply a current value I, 2I, 4I, 8I, 16I, or 32I. For example, the ratio channel widths of transistors functioning as current sources is set to be 1:2:4:8:16:32.

It is to be noted that although the number of degradation lines should be equal to that of light emitting elements, the degradation line A showing the least degradation and the degradation line B showing the most degradation are only illustrated in FIG. 13A for convenience.

Supposed that the degradation line A is a reference line in this graph. A signal current based on the degradation line A is set in the first current source which corresponds to a reference power supply. In other words, a signal current set in the first current source varies in accordance with the degradation of a light emitting element with time.

Then, a signal current range between a signal current $I_A$ of a light emitting element A with the least degradation and a signal current $I_B$ of a light emitting element B with the most degradation (range to be divided in the drawing, which corresponds to a difference between the reference line (degradation line A) and the degradation line B) is divided into 64 different signal currents. That is, the second current source is set so as to supply 6-bit signal currents by dividing the range into 64 signal currents.

When a pixel is selected and a correction signal is generated in accordance with a degradation level of a light emitting element of the pixel, the second current source is set so as to supply a signal current which is corrected depending on the correction signal. The second current source can set 6-bit signal currents at this time.

In such a manner, a signal current to be corrected is set according to a degradation level of a selected light emitting element. Then, a driving current source is set with the first current source as reference.

In the correction method shown in FIG. 13A, the range to be divided is minimized, that is the range to be divided is not increased with the degradation with time. Accordingly, it is expected that the correction accuracy, namely the display performance is improved.

Described next is a correcting method shown in FIG. 13B, in which a reference line is equal to the initial current $I_0$.

Figure 13B:
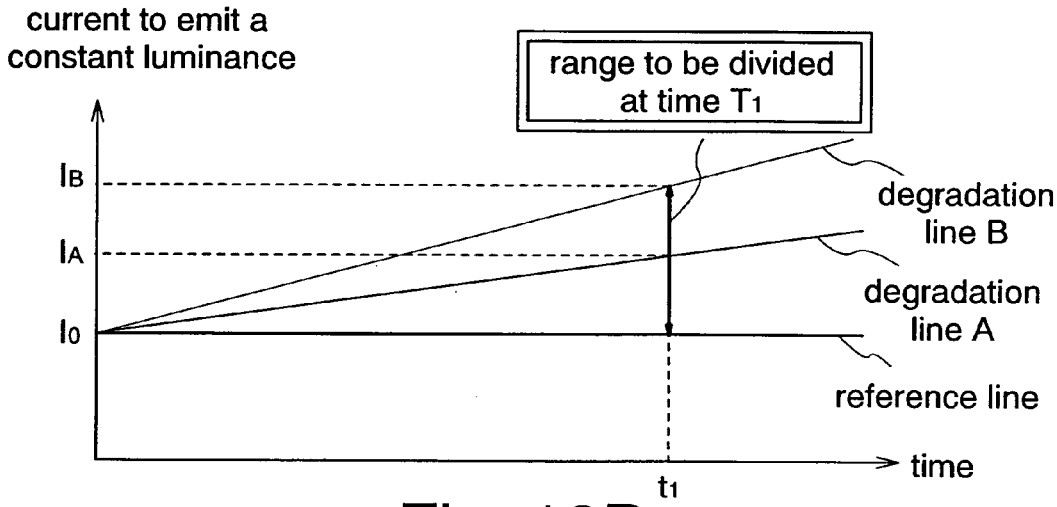

FIG. 13B is different from FIG. 13A in that a reference line is not a degradation line showing the degradation of a light emitting element with time but a constant initial current. The initial current is set by the first current source which corresponds to a reference current source. In other words, the first current source does not have to take the degradation of a light emitting element into consideration and has only to have a function of supplying a constant current value (not necessarily equal to an initial current).

The second current source sets a signal current taking the degradation with time (degradations shown by degradation lines A and B) into consideration. That is, the second current source sets a difference ($I_A$–$I_0$) between the reference line and the degradation line A or a difference ($I_B$–$I_0$) between the reference line and the degradation line B, for example. Accordingly, in the correction method shown in FIG. 13B, a range to be divided corresponds to a difference between the reference line and the degradation line of the light emitting element (range to be divided in the drawing) and it is divided into 64 signal currents.

Described next is a correcting method shown in FIG. 13C, in which a reference line varies in stepwise depending on the degradations of light emitting elements.

Figure 13C:
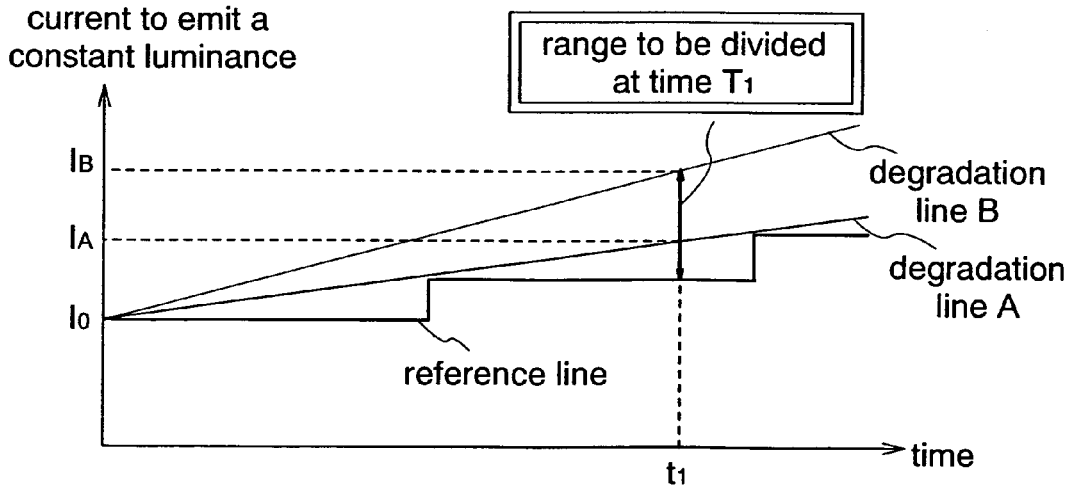

FIG. 13C is different from FIGS. 13A and 13B in that the reference line changes in stepwise. The first current source sets a signal current so as to obtain the reference line. The reference line may be raised one step when the degradation with time reaches some level, and can be set within the range below the degradation line A.

The second current source sets a signal current taking the degradation with time (degradations shown by degradation lines A and B) into consideration. That is, the second current source sets a difference between the reference line and the degradation line A or a difference between the reference line and the degradation line B.

By setting the reference line so as to be in stepwise as shown in FIG. 13C, the range to be divided is not increased with the degradation with time as compared with in FIG. 13B. Thus, the correction accuracy, namely the display performance is expected to be enhanced.

In FIGS. 13A to 13C, the method of setting a signal current of a lower reference line by a reference current source is explained. On the other hand, the upper range of the degradation can also be set by the reference current source and an example thereof is hereinafter described with reference to FIGS. 14A to 14C.

Figure 14A:
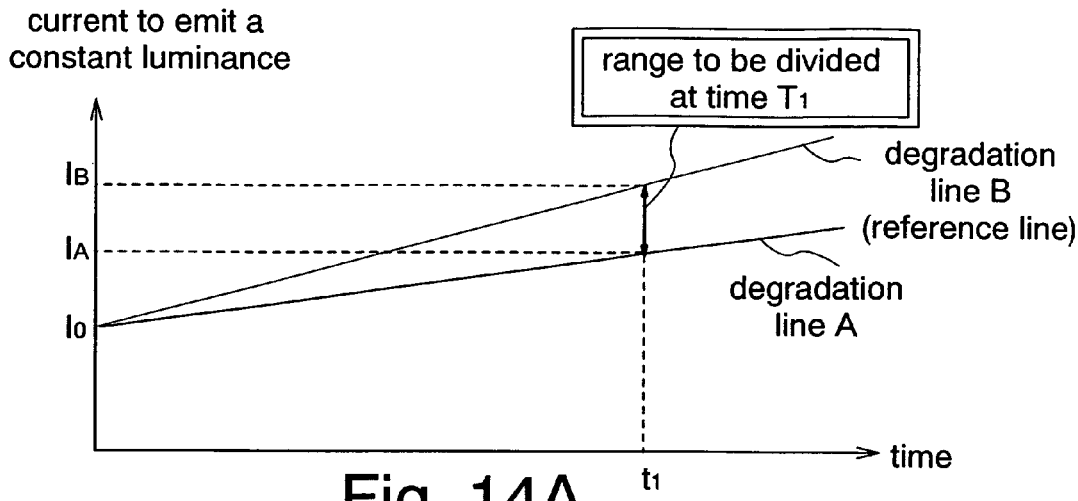
FIGS. 14A to 14C are diagrams each showing a degradation correction method of a light emitting element of the invention.

As shown in FIG. 14A, the degradation line B is used as a reference line in order to set the upper range to be divided. Then, the first current source sets a signal current in accordance with the degradation line B as in FIG. 13A. The second current source sets a signal current in accordance with the degradation line. The division and the setting of a light emitting element are performed in the same manner as described using FIG. 13A.

Figure 14B:
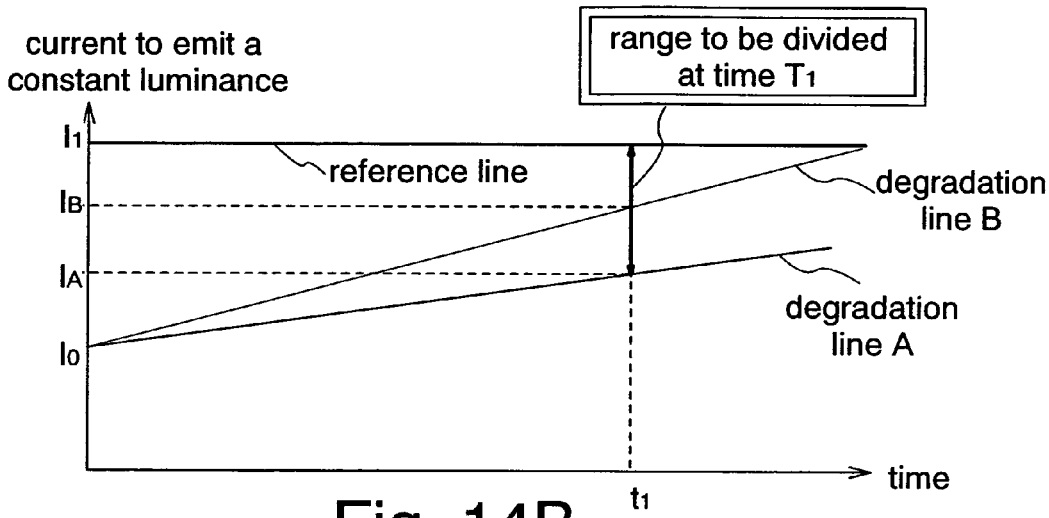

In FIG. 14B, a reference line is equal to a constant current $I_1$ and sets the upper range to be divided. FIG. 14B is characterized in that the constant current $I_1$ is the reference line and the first current source sets the current $I_1$. In other words, the first current source supplies a constant current value regardless of the degradation of a light emitting element. Then, the first current source sets a signal current in accordance with the reference line as in FIG. 13B. The second current source sets a signal current in accordance with the degradation lines A and B. The division and the setting of a light emitting element are performed in the same manner as described using FIG. 13B.

Figure 14C:
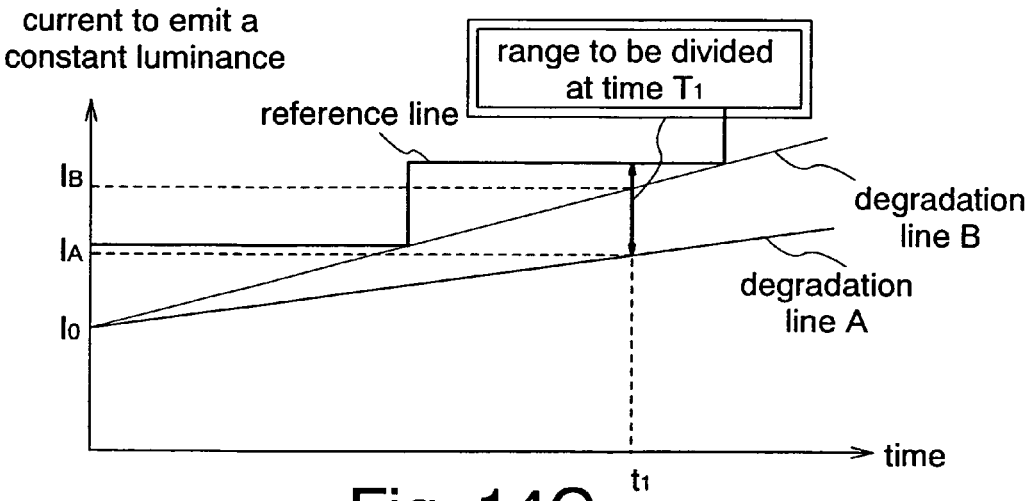
Figure 15A:
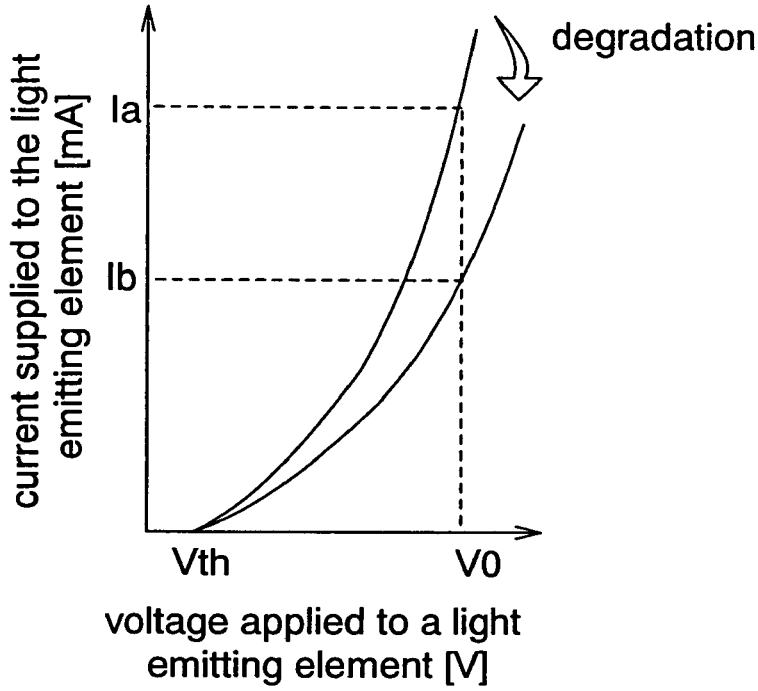
FIGS. 15A and 15B are diagrams each showing the degradation level of a light emitting element.
Figure 15B:
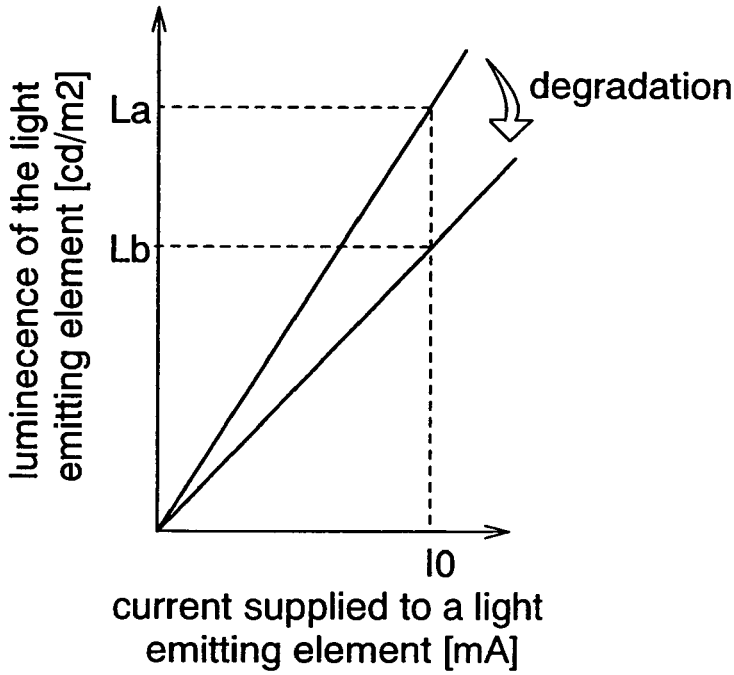

In FIG. 14C, a reference line varies in stepwise as a light emitting element degrades and sets the upper range to be divided. FIG. 14C is characterized in that the reference line is stepwise. The first current source sets a signal current so as to obtain the reference line. The reference line may be raised one step when the degradation with time reaches some level, and can be set arbitrarily within the range above the degradation line B.

The second current source sets a signal current taking the degradation with time (degradations shown by degradation lines A and B) into consideration. That is, the second current source sets a difference between the reference line and the degradation line A or a difference between the reference line and the degradation line B, for example.

By dividing and correcting a current signal as described above, the loads of the first and the second current sources can be reduced and the degradation of a light emitting element can be corrected within the range recognizable by the human eye. It is to be noted that although the case of six bits is taken as an example, the number of divisions may be set arbitrarily depending on the application or the specification of the display device.

In the case where an image is rough even when it is displayed using the divided correcting a signal current or in the case where the number of divisions is reduced, a corrected luminance may be obtained by controlling a video signal. For example, a higher current value may be corrected by a lower video signal, whereas a lower current value may be corrected by a higher video signal.

As for the correction of a current value (signal current) according to the invention, a method for setting the lower range of the degradation is described with reference to FIGS. 13A to 13C and a method for setting the upper range thereof is described with reference to FIGS. 14A to 14C. These two methods can be freely combined with each other.

Embodiment Mode 4

In this embodiment mode, the whole display device is described with reference to FIG. 4.

Figure 4:
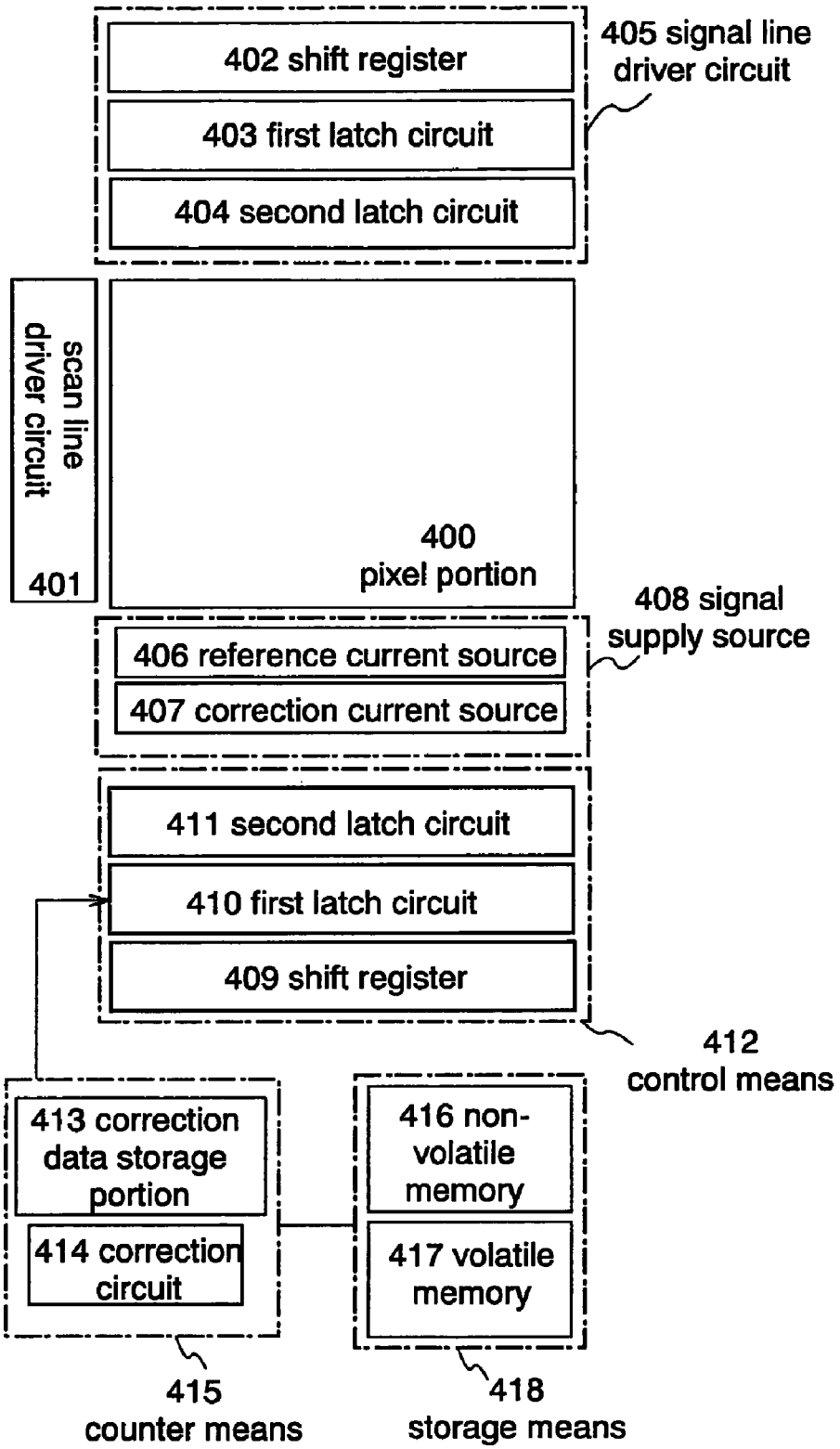
FIG. 4 is a block diagram showing a display device of the invention.

A display device shown in FIG. 4 comprises a pixel portion 400 which includes light emitting elements each provided at an intersection of a signal line and a scan line, and a driving current source for supplying a corrected signal current to the light emitting elements, namely for driving them, a scan line driver circuit 401 for selecting a scan line sequentially, namely for driving it, a shift register 402, a first latch circuit 403, and a second latch circuit 404. The display device further comprises a signal line driver circuit 405 for inputting a video signal to a signal line, namely for driving it, a signal supply source 408 which includes at least either a reference current source 406 or a correction current source 407, a control means 412 which includes a shift register 409, a first latch circuit 410 and a second latch circuit 411, a counter means 415 which includes a correction data storage portion 413 and a correction circuit 414, and a storage means 418 which includes a non-volatile memory 416 at least and may further include a volatile memory 417. Note that, decoders may be employed instead of the shift registers 402 and 409 of the signal line driver circuit 405 and the control means 412.

Figure 5:
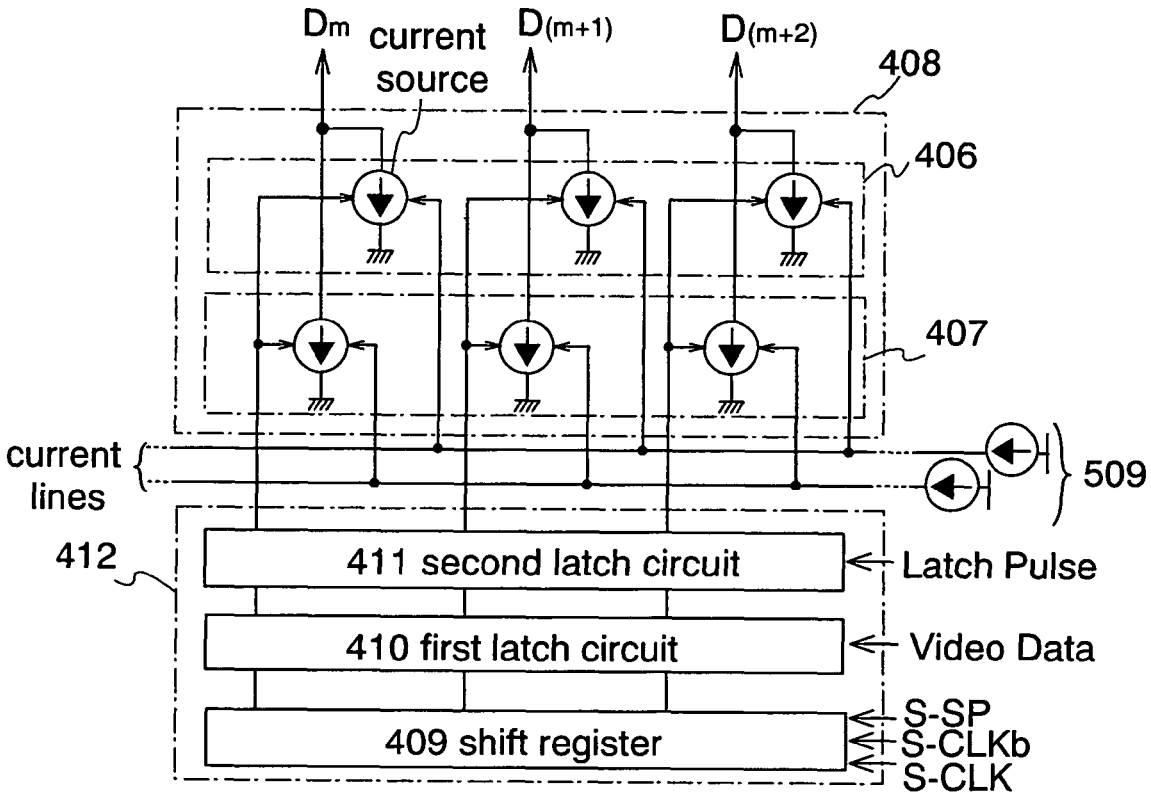
FIG. 5 is a block diagram showing a display device of the invention.

FIG. 5 shows a specific example of the signal supply source 408. The signal supply source 408 comprises the reference current source 406 including a plurality of current sources, and the correction current source 407 including a plurality of current sources. Each of the current sources 406 and 407 is connected to a standard current source 509 via a current line.

Figure 19:
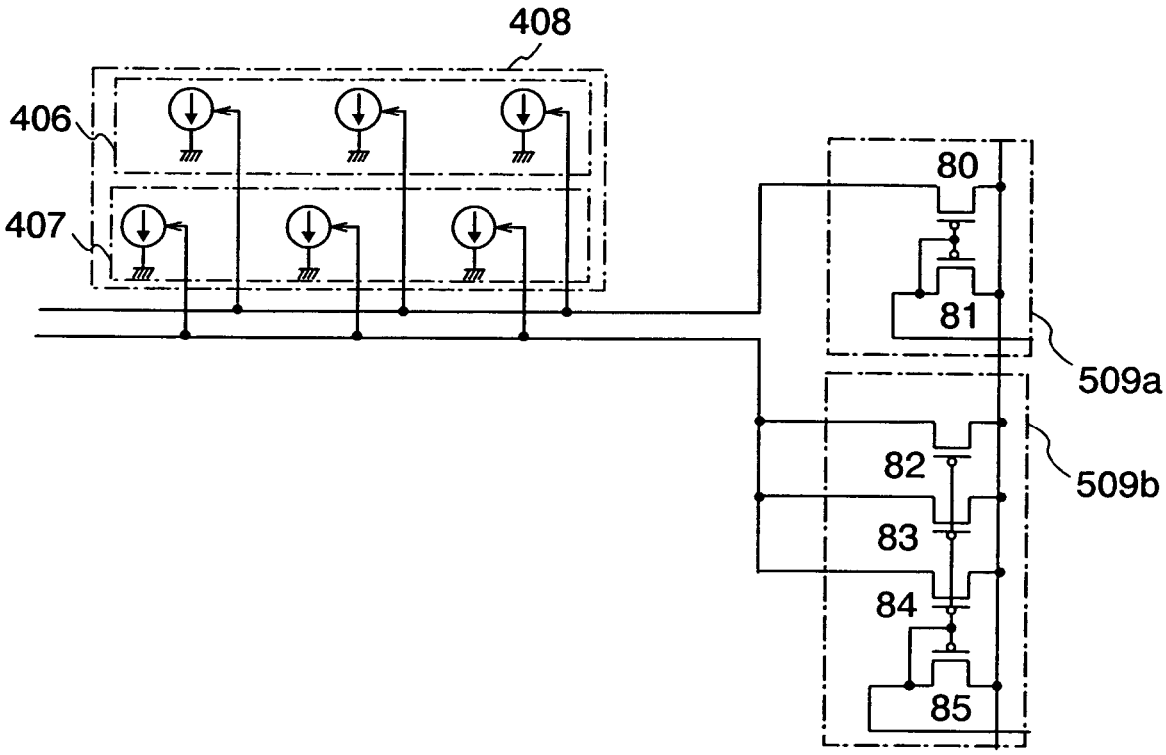
FIG. 19 is a diagram showing a standard current source of the invention.

FIG. 19 shows a specific example of the standard current source 509. A standard current source 509*a* connected to the reference current source 406 comprises a current mirror circuit formed of transistors having the same conductivity. For example, P-channel transistors Tr80 and Tr81 are connected to each other so as to form a current mirror circuit.

A standard current source 509*b* connected to the correction current source 407 comprises transistors having the same conductivity, whose gate electrodes are connected to each other, and at least one transistor which forms a current mirror circuit with one of the transistors having the same conductivity. For example, the standard current source 509*b* comprises P-channel transistors 82, 83, 84, and a P-channel transistor 85 which forms a current mirror circuit with the Tr84. In particular, when the plurality of transistors 82 to 84 are provided and the channel widths thereof are made different from each other, a plurality of current values can be supplied.

The control means 412 comprises the shift register 409 to which a clock signal (S-CLK), a start pulse (S-SP) and a clock inverted signal (S-CLKb) are input, the first latch circuit 410 to which a correction video signal (Video Data) is input, and the second latch circuit 411 to which a latch pulse is input.

When a correction video signal is input from the control means 412 to a plurality of correction current sources, a current is supplied from the standard current source 509 and a signal current is set in accordance with the correction video signal. Similarly, the reference current source 406 sets a corrected signal current.

Such a corrected signal current is supplied from the signal current source 408 to a driving current source of each pixel via current lines. When a video signal supplied from a signal line is turned ON, a light emitting element emits light in accordance with the corrected signal current.

An operation of such a display device is specifically described next.

Explanation is first made on an operation of the shift register 402, the first latch circuit 403 and the second latch circuit 404, which are included in the signal line driver circuit 405. The shift register 402 is formed of a plurality of lines of flip flop circuits (FF) and the like, and a clock signal (S-CLK), a start pulse (S-SP) and a clock inverted signal (S-CLKb) are input thereto. In accordance with the timing of these signals, a sampling pulse is output in sequence.

A sampling pulse output from the shift register 402 is input to the first latch circuit 403. A video signal for a corrected signal has already been input to the first latch circuit 403, thus the first latch circuit holds the video signal line by line in accordance with the timing of the sampling pulse input.

When the first latch circuit 403 completes the holding of video signals up to in the last line, a latch pulse is input to the second latch circuit 404 during a horizontal fly-back period and the video signals held in the first latch circuit 403 are simultaneously transferred to the second latch circuit 404. Then, one row of the video signals held in the second latch circuit 404 is input to the pixel portion at one time.

While the video signals held in the second latch circuit 404 are input to the pixel portion, another sampling pulse is output from the shift register 402. Such an operation is repeated to process video signals of one frame. It is to be noted that the signal line driver circuit 405 may comprise a means for converting a digital signal into an analog signal (a D/A converter).

The same operation is performed in the shift register 409, the first latch circuit 410 and the second latch circuit 411, which are included in the control means 412. Thus, a correction video signal is input to the first latch circuit 410. It is to be noted that the correction video signal is determined by the storage means 418 and the counter means 415.

The storage means 418 comprises at least a non-volatile memory 416 which records degradation data of a light emitting element. That is, the degradation data of the light emitting element is not erased even when the display device is turned OFF. The storage means may also comprise a volatile memory which records display data.

The signal supply source 408 comprises a reference current source 406 and a correction current source 407 for each signal line, and sets a signal current which is corrected in accordance with the degradation. Note that in the invention, the reference current source 406 and the correction current source 407 are not necessarily provided for each signal line, and a single or a plurality of current sources may be provided.

The counter means 415 comprises a correction circuit 414 and a correction data storage portion 413. The correction circuit comprises a counter circuit for measuring the amount of light emitting time of a light emitting element, and stores the amount of light emitting time of a light emitting element. The counter circuit measures the amount of light emitting time of a light emitting element in accordance with a video signal data input from the signal line driver circuit to each light emitting element. The correction data storage portion 413 records and stores data on the accumulated amount of light emitting time of a light emitting element and data on a correction signal estimated by reference data and a degradation level depending on the amount of light emitting time.

A correction signal is input to the control means 412 in accordance with the degradation data stored in the non-volatile memory 416 and the amount of light emitting time of a light emitting element measured by the counter circuit.

Specifically, a corrected current to be supplied to each driving current source is generated in accordance with correction signals which are sequentially input to the first latch circuit 410 of the control means 412 and then transferred to the second latch circuit of the control means 412 at one time. Then, a corrected signal current is generated depending on the reference current source 406 and the correction current source 407 which are included in the signal supply source 408.

When driving the display device, a High signal is sequentially input from the scan line driver circuit 401 to each scan line, to select each light emitting element, namely each pixel. A corrected signal current is supplied to the selected pixel via each current line.

As described above, by setting and supplying a signal current in accordance with the degradation of a light emitting element, luminance decay due to the degradation can be prevented and a lower image quality can also be inhibited.

The display device shown in this embodiment mode is just an example, and the invention is not limited to this configuration, namely the configuration and arrangement of each circuit. For example, the signal line driver circuit 405 and circuits such as the signal supply source 408 may be provided in the same direction relative to the pixel portion 400. Moreover, the shift register may be used as both of that in the signal line driver circuit 405 and that in the control means 412 in order to reduce an area occupied by the driver circuit.

The aforementioned shift register 409, first latch circuit 410 and second latch circuit 412 of the control means 412 as well as the current source can be specifically achieved with reference to Japanese Patent Application No. 2003-540968, Japanese Patent Application Laid-Open No. 2003-202833, Japanese Patent Application No. 2003-54966, and Japanese Patent Application No. 2003-540970. Further, as shown in Japanese Patent Application Laid-Open No. 2003-228333 and Japanese Patent Application Laid-Open No. 2003-255880, a switching circuit may be provided between the signal line and the current source for setting a signal current, which is included in the signal supply source 408 and the like. As a result, the current source and the signal line are switched periodically even when transistors of the current source degrade or have variations, leading to a more uniform display.

Embodiment Mode 5

In this embodiment mode, an example of a display device in which a control means functions also as a signal supply source is described with reference to FIG. 6.

Figure 6:
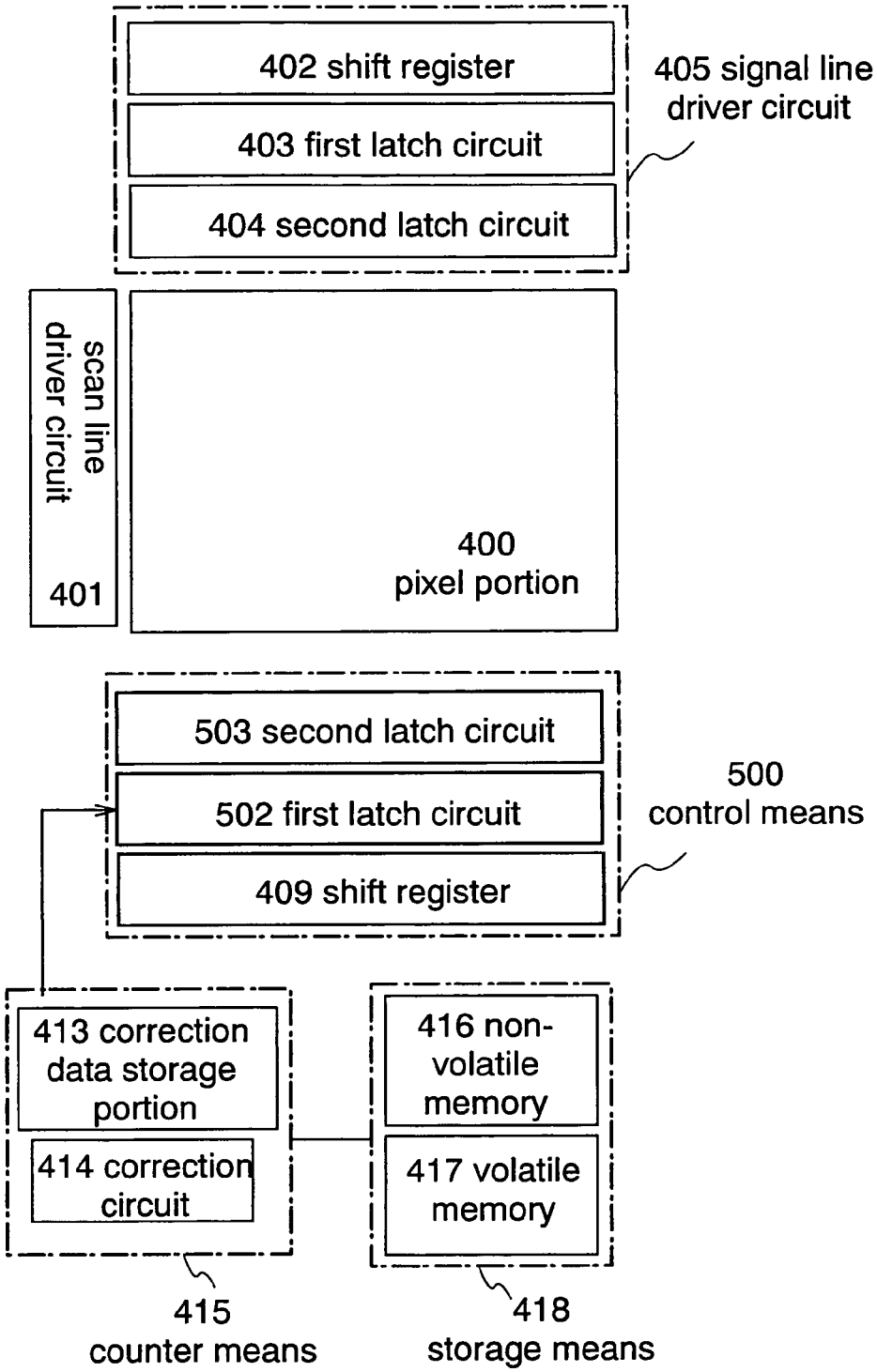
FIG. 6 is a block diagram showing a display device of the invention.

In FIG. 6, a reference current source 406 and a correction current source 408 of the signal supply source 408 in FIG. 4 are also used as a first latch circuit 502 or a second latch circuit 503 in the control means 500. That is, differently from in FIG. 4, a control means 500 in which a current source is shared between the latch circuits and the signal supply source 408 is provided in FIG. 6.

Figure 7:
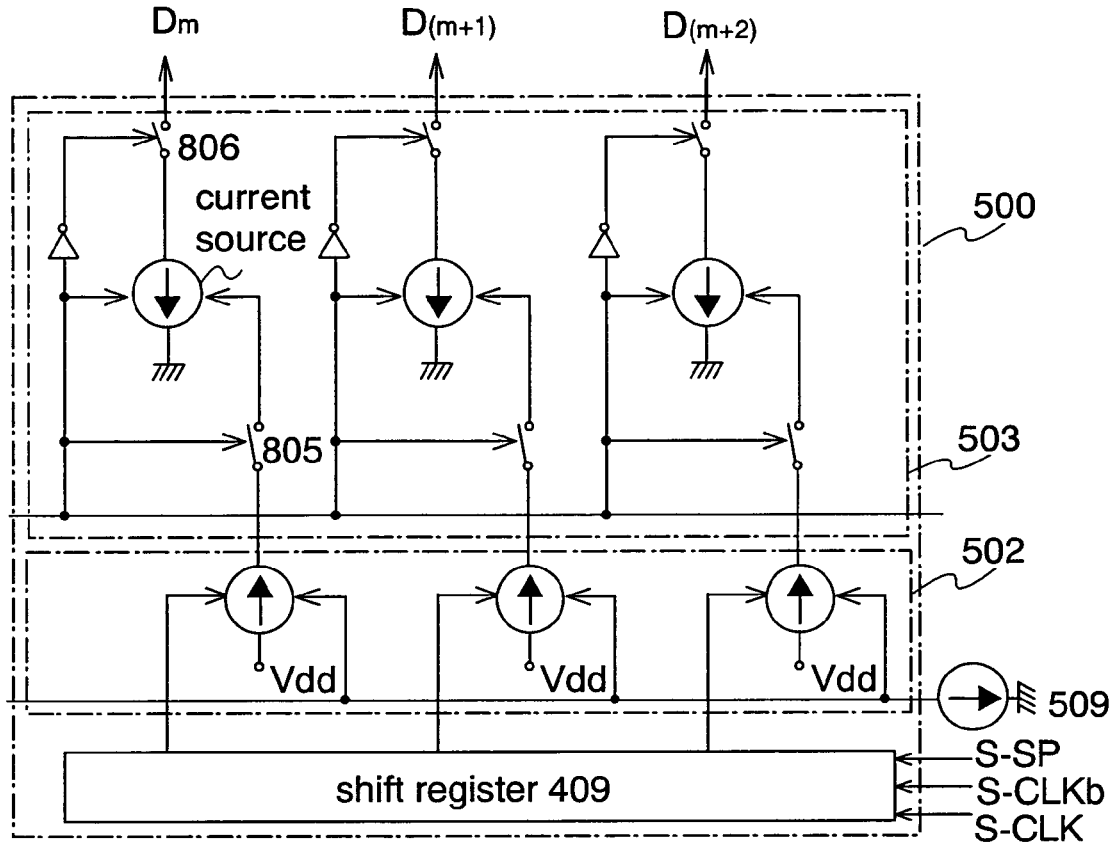
FIG. 7 is a block diagram showing a display device of the invention.

FIG. 7 shows a specific example of the control means 500 which includes a first latch circuit 502 and a second latch circuit 503. When a plurality of current sources of the first latch circuit 502 are selected by the shift register 409, a current is supplied from the standard current source 509. At this time, a video signal for a correction signal corresponding to the degradation of a light emitting element is input to the first latch circuit 502. When a switch 805 connected to each current source is turned ON, the corrected current is supplied to current sources of the second latch circuit 503. Then, a switch 806 connected to the switch 805 via an inverter is turned ON, and the corrected current is supplied to the driving current source of each pixel via the current lines $D_m$ to $D_{(m+2)}$. Subsequently, when a video signal supplied from a signal line is turned ON, a light emitting element emits light depending on the corrected signal current.

A specific configuration of the standard current source 509 in this embodiment mode may adopt the configuration shown in FIG. 19, particularly that of the standard current source 509*b*.

It is to be noted that in the invention, the reference current source and the correction current source are not necessarily provided for each signal line. Therefore, the second latch circuit 503 may comprise a single or a plurality of current sources for each signal line.

By sharing the current source as described above, luminance decay due to the degradation of a light emitting element can be prevented as well as a lower image quality. In addition, the cost for current source is reduced and an area occupied by a circuit portion is made smaller, leading to a narrower frame of the display device.

The display device shown in this embodiment mode is just an example, and the invention is not limited to this configuration, namely the configuration and arrangement of each circuit. For example, the signal line driver circuit 405 and circuits of the signal supply-source 408 and the like may be provided in the same direction relative to the pixel portion 400. Moreover, the shift register may be shared between the signal line driver circuit 405 and the control means 412 in order to reduce an area occupied by the driver circuit.

The aforementioned shift register 409, first latch circuit 410 and second latch circuit 412 of the control means 412 as well as the current source can be specifically achieved with reference to Japanese Patent Application No. 2003-540968, Japanese Patent Application Laid-Open No. 2003-202833, Japanese Patent Application No. 2003-54966, and Japanese Patent Application No. 2003-540970. Further, as shown in Japanese Patent Application Laid-Open No. 2003-228333 and Japanese Patent Application Laid-Open No. 2003-255880, a switching circuit may be provided between the signal line and the current source for setting a signal current, which is included in the signal supply source 408 and the like. As a result, the current source and the signal line are switched periodically even when transistors of the current source degrade or have variations, leading to a more uniform display.

Embodiment Mode 6

Described in this embodiment mode is a latch circuit of a control means, in which a pair of current sources are provided for each signal line and function also as a signal supply source. That is, an example of a display device which does not comprise a signal supply source and comprises a single latch circuit is explained with reference to FIG. 8.

Figure 8:
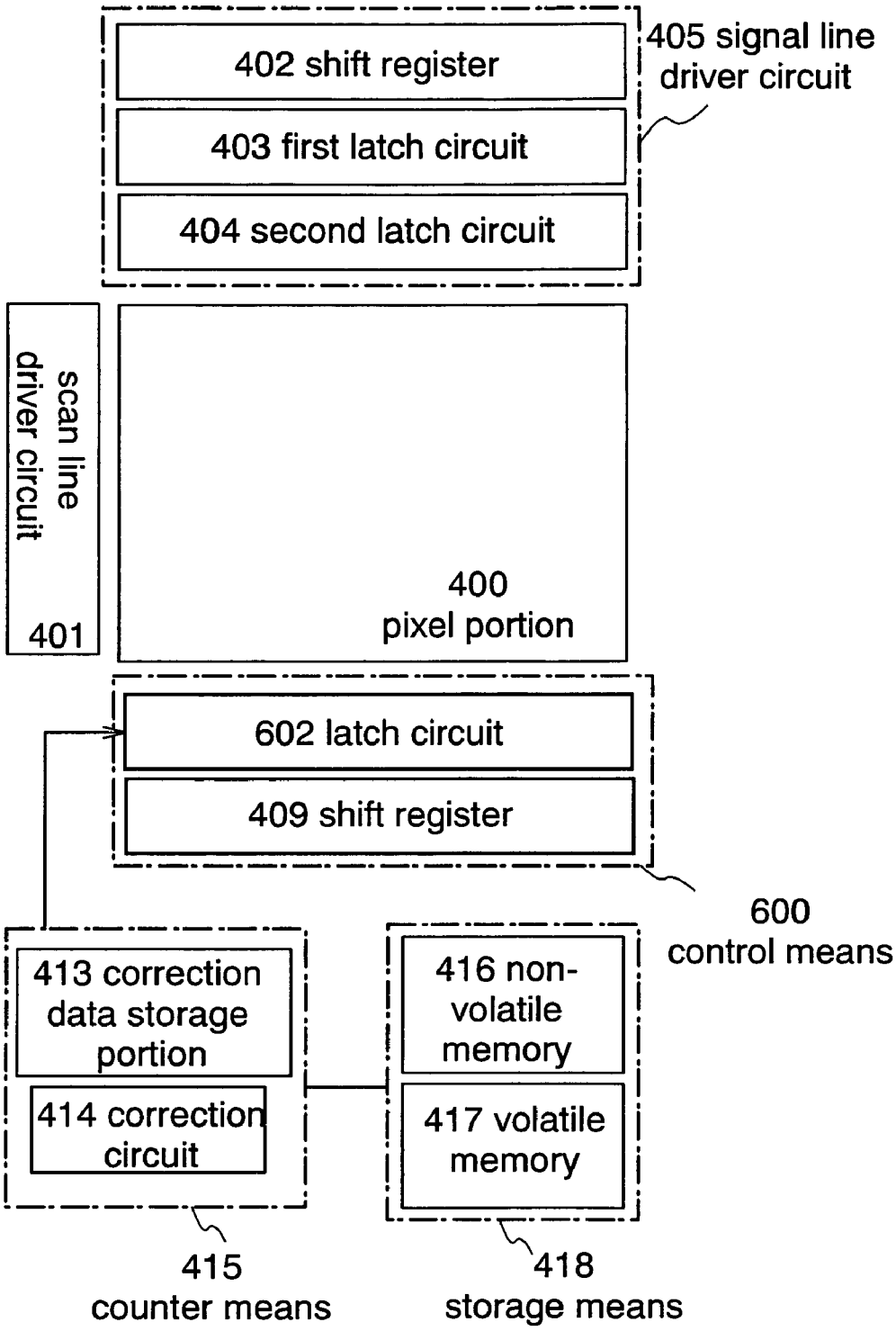
FIG. 8 is a block diagram showing a display device of the invention.

A configuration shown in FIG. 8 is different from the ones shown in FIGS. 4 and 6 in that a control means 600 including the shift register 409 and a latch circuit 602 is provided. Further, since the latch circuit 602 comprises a pair of current sources provided for each signal line, more than one latch circuit is not necessary differently from the configurations shown in FIGS. 4 and 6. In addition, the pair of current sources function also as a signal current source of a reference current source and a correction current source, therefore, the signal current source is not required.

Figure 9:
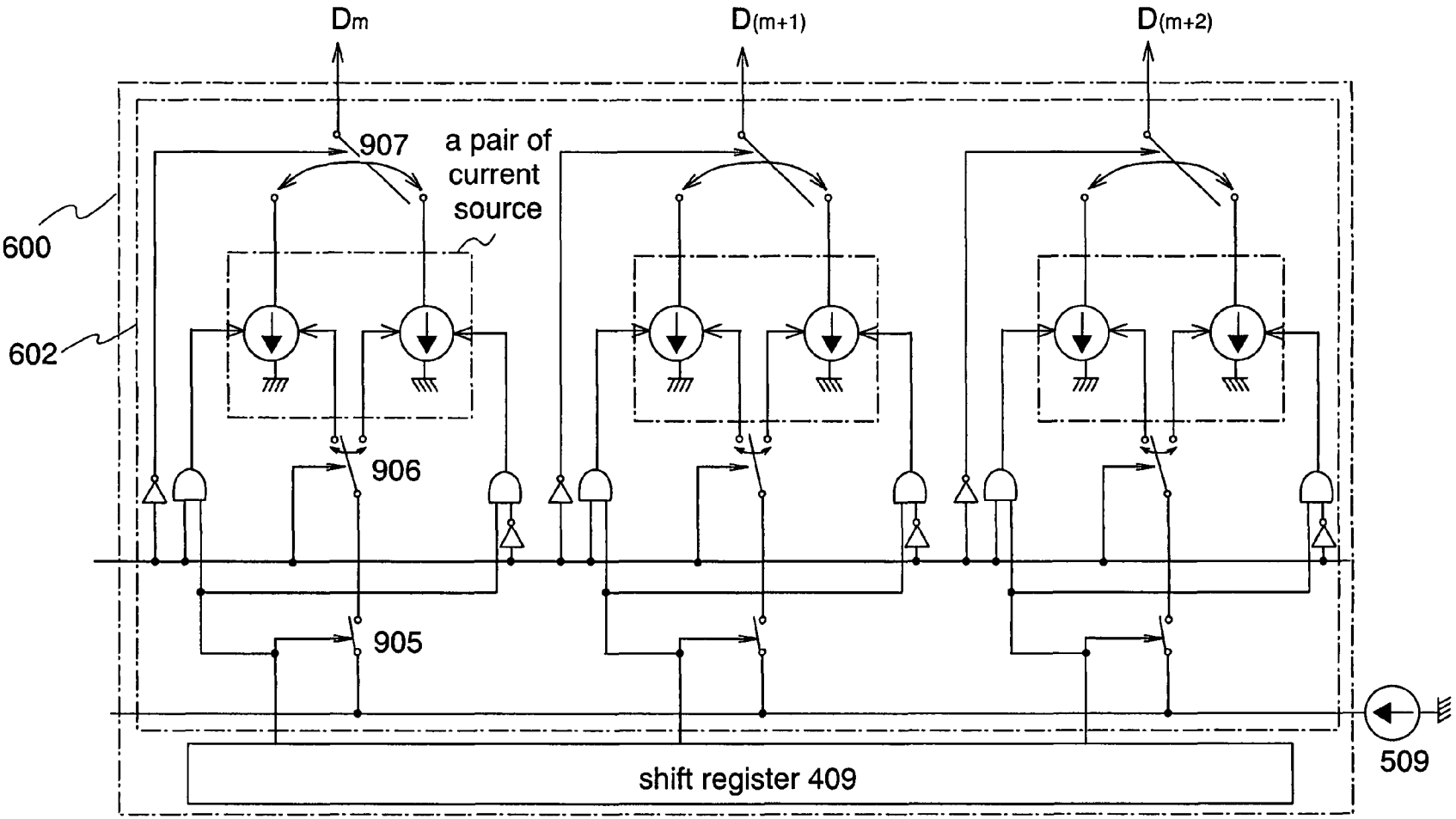
FIG. 9 is a block diagram showing a display device of the invention.

FIG. 9 shows a specific example of the control means 600 comprising the latch circuit 602. A video signal for a correction signal is input to the latch circuit 602 which includes a plurality of pairs of current sources. In accordance with the video signal for a correction signal, a current is supplied from the standard current source 509 to either one of the pair of current sources. At this time, a corrected current is supplied in accordance with the video signal for a correction signal.

While a corrected signal current is supplied to either one (a first current source) of the pair of current sources (setting period), a corrected signal current is supplied from the other (a second current source) of the pair of current sources to a driving current source via current lines $D_m$ and $D_{(m+1)}$ (writing period). The setting period and the writing period are switched by switches SW 905 and SW 906 which are provided between the shift register 409 and the first and the second current sources. A switch SW 907 is provided between a driving current source and the first and the second current sources, and controls which of the current sources supplies a corrected signal current to the driving current source, namely, which of the current sources is used for the writing period.

According to such a configuration, luminance decay due to the degradation of a light emitting element can be prevented as well as a lower image quality. In addition, an area occupied by a circuit portion is made smaller, leading to a narrower frame of the display device.

The display device shown in this embodiment mode is just an example, and the invention is not limited to this configuration, namely the configuration and arrangement of each circuit. For example, the signal line driver circuit and circuits of the signal supply source and the like may be provided in the same direction relative to the pixel. Moreover, the shift register may be shared between the signal line driver circuit and the signal supply source in order to reduce an area occupied by the driver circuit.

However, it is preferable to provide two shift registers one of which is for a video signal and the other is for setting a corrected current value. This is because the shift register for a video signal is required to be driven at a high frequency of about 60 Hz, whereas the shift register for setting a current value is required to be driven at a frequency of about 20 Hz and to set a current value which is accurately corrected by taking some time.

The aforementioned shift register and pair of current sources can be specifically achieved with reference to Japanese Patent Application No. 2003-540968, Japanese Patent Application Laid-Open No. 2003-202833, Japanese Patent Application No. 2003-54966, and Japanese Patent Application No. 2003-540970. Further, as shown in Japanese Patent Application Laid-Open No. 2003-228333 and Japanese Patent Application Laid-Open No. 2003-255880, a switching circuit may be provided between the signal line and the current source for setting a signal current, which is included in the signal supply source 408 and the like. As a result, the current source and the signal line are switched periodically even when transistors of the current source degrade or have variations, leading to a more uniform display.

Embodiment Mode 7

In this embodiment mode, a timing of setting a corrected signal current is described with reference to FIG. 10.

Figure 10:
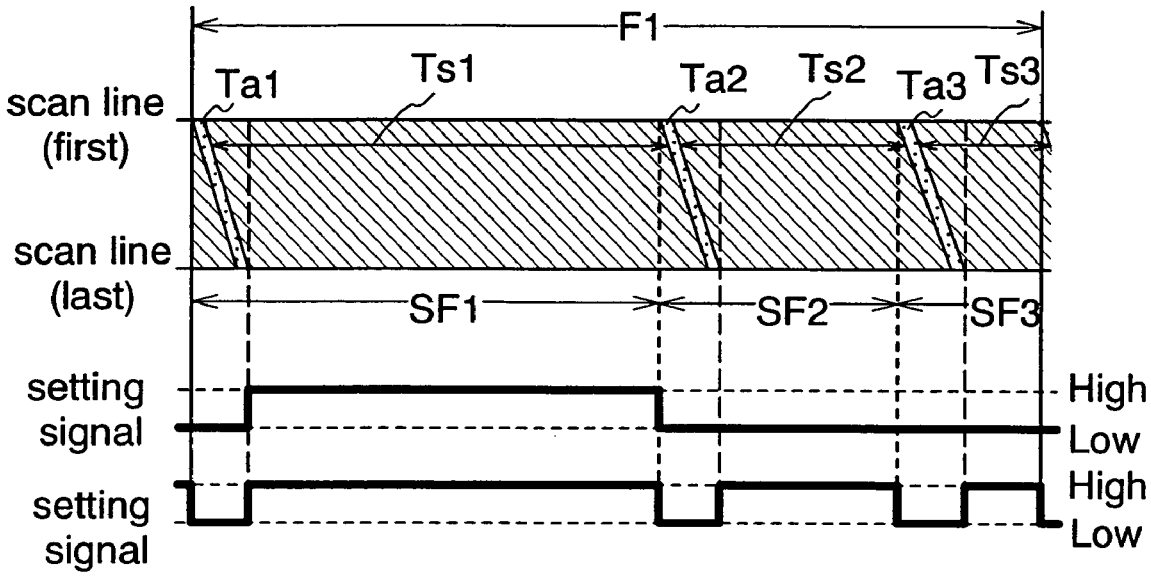
FIG. 10 is a timing chart of a display device of the invention.

The upper part of FIG. 10 shows a timing chart in the case where one frame period is divided into three subframe periods (SF1 to SF3). Each of the subframe periods SF1 to SF3 comprises writing periods (address periods) Ta1 to Ta3 respectively in which a scan line is sequentially selected and a video signal is input from a signal line, and display periods (light emitting periods) Ts1 to Ts3 respectively in which an image is displayed depending on the video signal. Each of the writing periods is provided at the beginning of each subframe period as an example, though the invention is not limited to this and each writing period may be provided in any part of each subframe period.

The middle part and lower part of FIG. 10 show waveforms of a setting signal for setting a corrected signal current. In the middle part of FIG. 10, a setting signal is High from the end of the writing period Ta1 to the beginning of Ta2. That is, while the writing is not performed, a setting signal is input and a corrected signal current is set. Alternatively, as shown in the lower part of FIG. 10, a setting signal may be High while the writing is not performed in each subframe period. This case is preferable since enough time for setting can be taken.

During a period in which the writing is not performed, a signal line driver circuit is not driven for writing a video signal to a pixel. Therefore, the shift register and the latch circuit may be used as both of those in the signal line driver circuit and in the control means. As a result, an area occupied by the driver circuit is reduced, leading to a narrower frame.

On the other hand, in the case where the shift register and the latch circuit are provided in each of the signal line driver circuit and the control means, a corrected signal current can be set at any time. However, a timing of writing a corrected signal current to the driving current source is provided in a period other than the writing period.

The timing of setting a corrected signal current is described above. The invention may also be applied to the case of driving with a full frame period as well as the case in which one frame period is divided into more subframe periods and an erasing period is provided.

Further, a setting order may be at random and a corrected signal current may be set only in a pixel selected by the latch circuit of the control means.

As set forth above, a timing of inputting a setting signal can be determined arbitrarily. It is needless to say that a corrected signal current, namely a current value can be set accurately by taking enough time for setting.

Embodiment Mode 8

The display device of the invention can be applied to various electronic apparatuses such as a video camera, a digital camera, a goggle type display (a head mounted display), a navigation system, an audio reproducing device (an in-car audio system, a component stereo, or the like), a notebook personal computer, a game player, a portable information terminal (a mobile computer, a mobile phone, a portable game player, an electronic book, or the like), and an image reproducing device provided with a recording medium (specifically, a device which is capable of reproducing a recording medium such as DVD (Digital Versatile Disc) and which includes a display for displaying the reproduced image). In particular, the display device of the invention is desirably used for a portable information terminal whose screen is often seen from an oblique direction and which requires a wide viewing angle. Specific examples of such electronic apparatuses are shown in FIGS. 17A to 17H.

Figure 17A:
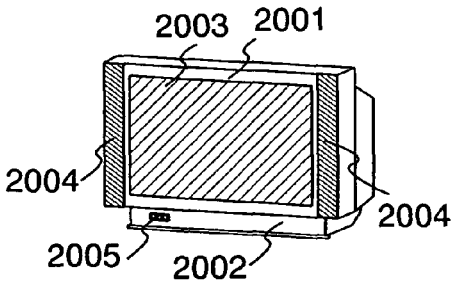
FIGS. 17A to 17H are views showing electronic apparatuses according to the invention.

FIG. 17A shows a display device which includes a housing 2001, a supporting base 2002, a display portion 2003, speaker portions 2004, a video input terminal 2005, and the like. The display device of the invention can be applied to the display portion 2003. The display device shown in FIG. 17A is completed by using the invention. Since the display device emits light by itself, it does not require a back light and thus the display portion thereof can be made thinner than that of a liquid crystal display device. It is to be noted that the display device includes all the information display devices such as used for personal computer, TV broadcast receiving, or advertisement display.

Figure 17B:
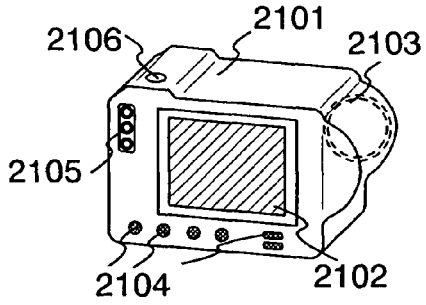

FIG. 17B shows a digital still camera which includes a main body 2101, a display portion 2102, an image receiving portion 2103, operating keys 2104, an external connecting port 2105, a shutter 2106, and the like. The display device of the invention can be applied to the display portion 2102.

Figure 17C:
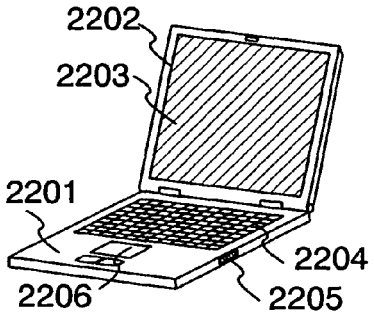

FIG. 17C shows a notebook personal computer which includes a main body 2201, a housing 2202, a display portion 2203, a keyboard 2204, an external connecting port 2205, a pointing mouse 2206, and the like. The display device of the invention can be applied to the display portion 2203.

Figure 17D:
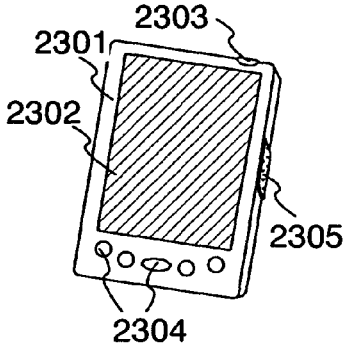

FIG. 17D shows a mobile computer which includes a main body 2301, a display portion 2302, a switch 2303, operating keys 2304, an infrared port 2305, and the like. The display device of the invention can be applied to the display portion 2302.

Figure 17E:
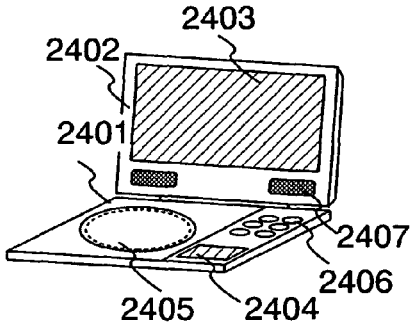

FIG. 17E shows a mobile image reproducing device provided with a recording medium (specifically a DVD reproducing device), which includes a main body 2401, a housing 2402, a display portion A 2403, a display portion B 2404, a recording medium (DVD or the like) reading portion 2405, an operating key 2406, a speaker portion 2407, and the like. The display portion A 2403 mainly displays image data whereas the display portion B 2404 mainly displays character data. The display device of the invention can be applied to both the display portion A 2403 and the display portion B 2404. It is to be noted that the image reproducing device provided with a recording medium includes a home video game player and the like.

Figure 17F:
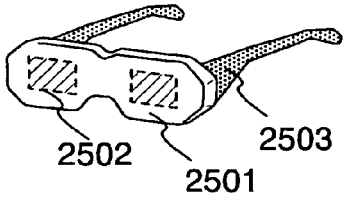

FIG. 17F shows a goggle type display (head mounted display) which includes a main body 2501, a display portion 2502, and an arm portion 2503. The display device of the invention can be applied to the display portion 2502.

Figure 17G:
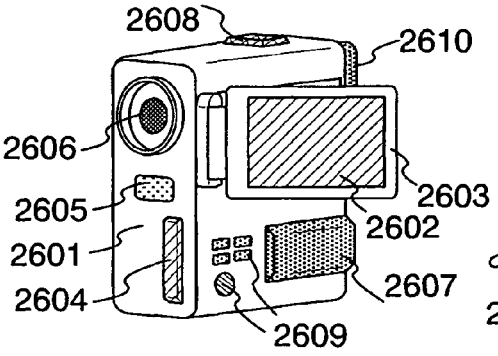

FIG. 17G shows a video camera which includes a main body 2601, a display portion 2602, a housing 2603, an external connecting port 2604, a remote control receiving portion 2605, an image receiving portion 2606, a battery 2607, an audio input portion 2608, operating keys 2609, an eye piece 2610 and the like. The display device of the invention can be applied to the display portion 2602.

Figure 17H:
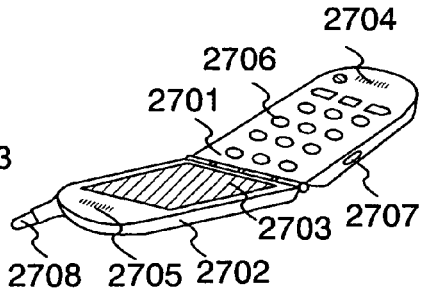
Figure 18:
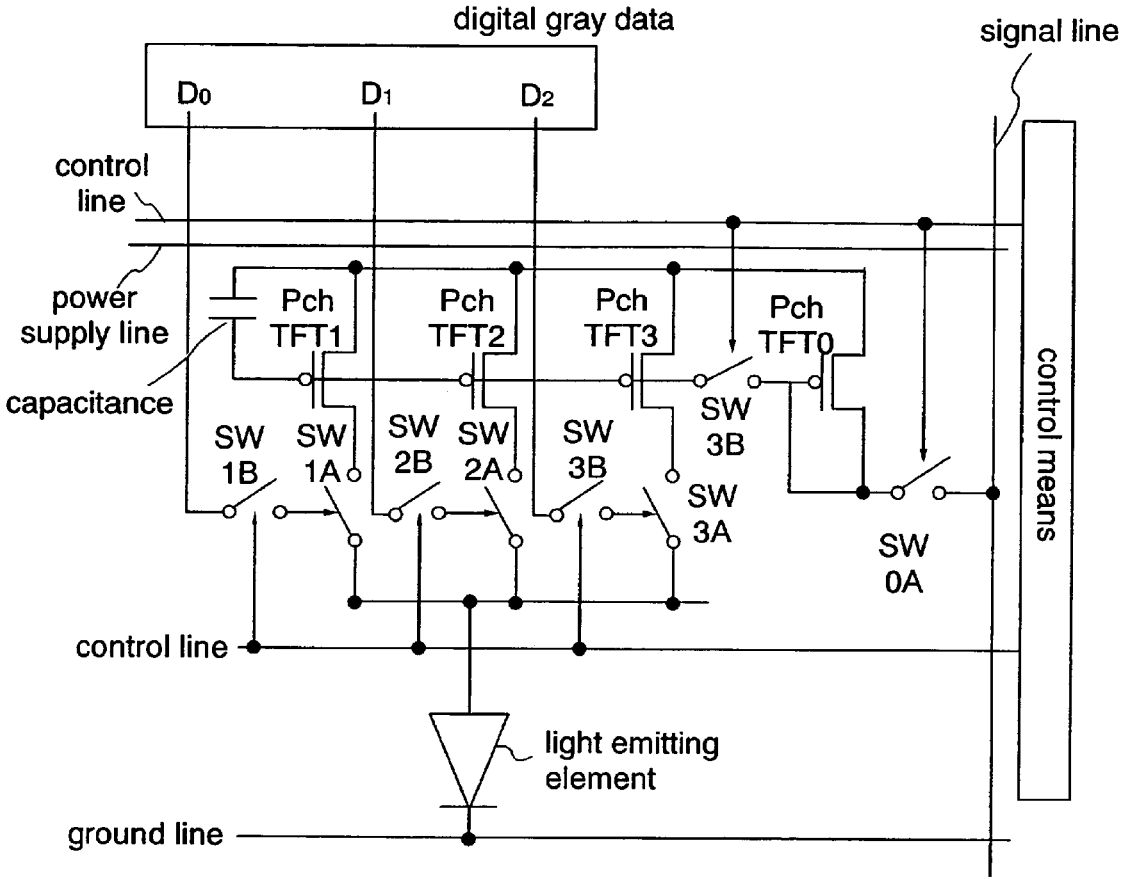
PRIOR ART Fig. 18
FIG. 18 is a diagram showing a display device which comprises a light emitting element.

FIG. 17H shows a mobile phone which includes a main body 2701, a housing 2702, a display portion 2703, an audio input portion 2704, an audio output portion 2705, an operating key 2706, an external connecting port 2707, an antenna 2708, and the like. The display device of the invention can be applied to the display portion 2703. It is to be noted that when white characters are displayed on a black background in the display portion 2703, the power consumption of the mobile phone can be reduced.

Since light emitting parts consume power in a display device, information is desirably displayed so that the light emitting parts occupy as small area as possible. Accordingly, in the case where the display device is used for a display portion which mainly displays character data, such as the one of a mobile phone or an audio reproducing device, it is preferably driven so that the character data emits light by using non-light emitting parts as background.

This application is based on Japanese Patent Application serial no. 2003-283683 filed in Japan Patent Office on 31th, Jul., 2003, the contents of which are hereby incorporated by reference.

Although the present invention has been fully described by way of Embodiment Modes and Embodiments with reference to the accompanying drawings, it is to be understood that various changes and modifications will be apparent to those skilled in the art. Therefore, unless such changes and modifications depart from the scope of the present invention hereinafter defined, they should be constructed as being included therein.

What is claimed is:

1. A display device comprising:

a pixel comprising:

a light emitting element;

a first current source circuit configured to supply a first current to the light emitting element; and a switch provided between the first current source circuit and the light emitting element; and a second current source circuit configured to supply a second current to the first current source circuit, wherein a value of the second current depends on degradation of the light emitting element, and wherein a value of the first current depends on the value of the second current.

2. The display device according to claim 1, wherein the first current source circuit comprises a transistor and a capacitor for holding a gate-source voltage of the transistor.

3. The display device according to claim 1, wherein the display device is one selected from the group consisting of a video camera, a digital camera, a goggle type display, a navigation system, an audio reproducing device, a notebook personal computer, a game player, a portable information terminal, and an image reproducing device provided with a recording medium.

4. A display device comprising:

a pixel comprising:

a light emitting element;

a first current source circuit configured to supply a first current to the light emitting element; and a switch provided between the first current source circuit and the light emitting element;

a second current source circuit configured to supply a second current to the first current source circuit; and a control means for controlling the second current source circuit, wherein a value of the second current depends on degradation of the light emitting element, and wherein a value of the first current depends on the value of the second current.

5. The display device according to claim 4, wherein the first current source circuit comprises a transistor and a capacitor for holding a gate-source voltage of the transistor.

6. The display device according to claim 4, wherein the display device is one selected from the group consisting of a video camera, a digital camera, a goggle type display, a navigation system, an audio reproducing device, a notebook personal computer, a game player, a portable information terminal, and an image reproducing device provided with a recording medium.

7. A display device comprising:

a pixel comprising:

a first current source circuit configured to supply a first current to a light emitting element; and a switch provided between the first current source circuit and the light emitting element; and a second current source circuit configured to supply a second current to the first current source circuit, wherein a value of the second current depends on degradation of the light emitting element, and wherein a value of the first current depends on the value of the second current.

8. The display device according to claim 7, wherein the first current source circuit comprises a transistor and a capacitor for holding a gate-source voltage of the transistor.

9. The display device according to claim 7, wherein the display device is one selected from the group consisting of a video camera, a digital camera, a goggle type display, a navigation system, an audio reproducing device, a notebook personal computer, a game player, a portable information terminal, and an image reproducing device provided with a recording medium.

10. A display device comprising:

a pixel comprising:

a first current source circuit configured to supply a first current to a light emitting element; and a switch provided between the first current source circuit and the light emitting element;

a second current source circuit configured to supply a second current to the first current source circuit; and a control means for controlling the second current source circuit, wherein a value of the second current depends on degradation of the light emitting element, and wherein a value of the first current depends on the value of the second current.

11. The display device according to claim 10, wherein the first current source circuit comprises a transistor and a capacitor for holding a gate-source voltage of the transistor.

12. The display device according to claim 10, wherein the display device is one selected from the group consisting of a video camera, a digital camera, a goggle type display, a navigation system, an audio reproducing device, a notebook personal computer, a game player, a portable information terminal, and an image reproducing device provided with a recording medium.

13. The display device according to claim 10, wherein the control means comprises at least one of a shift register and a decoder.

14. The display device according to claim 10, wherein the control means comprises at least one of a shift register and a decoder, a first latch circuit and a second latch circuit.

15. A display device comprising:

a counter means for measuring an amount of light emitting time of a light emitting element and setting a correction signal in accordance with the amount of light emitting time;

a pixel comprising:

a first current source circuit configured to supply a first current to the light emitting element; and a switch provided between the first current source circuit and the light emitting element; and a second current source circuit configured to supply a second current to the first current source circuit, wherein a value of the second current depends on the correction signal, and wherein a value of the first current depends on the value of the second current.

16. The display device according to claim 15, wherein the first current source circuit comprises a transistor and a capacitor for holding a gate-source voltage of the transistor.

17. The display device according to claim 15, wherein the display device is one selected from the group consisting of a video camera, a digital camera, a goggle type display, a navigation system, an audio reproducing device, a notebook personal computer, a game player, a portable information terminal, and an image reproducing device provided with a recording medium.

18. The display device according to claim 15, wherein the pixel further comprises the light emitting element.

19. A display device comprising:

a storage means for storing degradation data of a light emitting element;

a pixel comprising:

a first current source circuit configured to supply a first current to the light emitting element; and a switch provided between the first current source circuit and the light emitting element; and a second current source circuit configured to supply a second current to the first current source circuit, wherein a value of the second current depends on the degradation data, and wherein a value of the first current depends on the value of the second current.

20. The display device according to claim 19, wherein the first current source circuit comprises a transistor and a capacitor for holding a gate-source voltage of the transistor.

21. The display device according to claim 19, wherein the display device is one selected from the group consisting of a video camera, a digital camera, a goggle type display, a navigation system, an audio reproducing device, a notebook personal computer, a game player, a portable information terminal, and an image reproducing device provided with a recording medium.

22. The display device according to claim 19, wherein the pixel further comprises the light emitting element.

* * * * *

UNITED STATES PATENT AND TRADEMARK OFFICE

CERTIFICATE OF CORRECTION

PATENT NO. : 7,961,160 B2
APPLICATION NO. : 10/890492
DATED : June 14, 2011
INVENTOR(S) : Hajime Kimura et al.

It is certified that error appears in the above-identified patent and that said Letters Patent is hereby corrected as shown below:

At column 1, line 56, “grayscale” should be --gray scale--;

At column 7, line 64, “element 1” should be --element 11--;

At column 18, line 31, “2003-54966” should be --2003-540966--;

At column 19, line 33, “2003-54966” should be --2003-540966--;

At column 20, line 44, “2003-54966” should be --2003-540966--.

Signed and Sealed this
Tenth Day of January, 2012

David J. Kappos

David J. Kappos
*Director of the United States Patent and Trademark Office*